US005591368A

United States Patent [19]

Fleischhauer et al.

[11] Patent Number: 5,591,368

[45] Date of Patent: Jan. 7, 1997

[54] HEATER FOR USE IN AN ELECTRICAL SMOKING SYSTEM

[75] Inventors: Grier S. Fleischhauer, Midlothian; Patrick H. Hayes, Chester; Constance H. Morgan, Chesterfield; Mohammad R. Hajaligol, Richmond; Michael L. Watkins, Chester; Walter A. Nichols, Richmond; David E. Sharpe, Chesterfield; Mary E. Counts, Richmond, all of Va.

[73] Assignee: Philip Morris Incorporated, New York, N.Y.

[21] Appl. No.: 426,165

[22] Filed: Apr. 20, 1995

Related U.S. Application Data

[63] Continuation-in-part of Ser. No. 380,718, Jan. 30, 1995, which is a continuation of Ser. No. 118,665, Sep. 10, 1993, Pat. No. 5,388,594, and a continuation-in-part of Ser. No. 943,504, Sep. 11, 1992, Pat. No. 5,505,214, which is a continuation-in-part of Ser. No. 666,926, Mar. 11, 1991, abandoned.

[51] Int. Cl.[6] ..... H05B 3/58; A24F 1/22

[52] U.S. Cl. ..... 219/535; 219/539; 338/310; 131/194

[58] Field of Search ..... 219/535–6, 538, 219/539, 260; 392/390, 391; 131/194, 197; 338/306, 310, 318, 319

[56] References Cited

U.S. PATENT DOCUMENTS

| | | | |
|---|---|---|---|
| 5,060,671 | 10/1991 | Counts et al. | 131/329 |
| 5,093,894 | 3/1992 | Deevi et al. . | |
| 5,095,921 | 3/1992 | Losee et al. | 131/194 |
| 5,224,498 | 7/1993 | Deevi et al. | 131/194 |
| 5,228,460 | 7/1993 | Sprinkel et al. | 131/194 |
| 5,235,157 | 8/1993 | Blackburn | 219/268 |
| 5,249,586 | 10/1993 | Morgan et al. . | |
| 5,274,214 | 12/1993 | Blackburn | 219/268 |
| 5,285,050 | 2/1994 | Blackburn | 219/268 |
| 5,322,075 | 6/1994 | Deevi et al. | 131/194 |
| 5,353,813 | 10/1994 | Deevi et al. | 131/194 |
| 5,388,594 | 2/1995 | Counts et al. . | |
| 5,408,574 | 4/1995 | Deevi et al. . | |

FOREIGN PATENT DOCUMENTS

| | | |
|---|---|---|
| 64-17386 | 1/1989 | Japan . |
| WO95/02970 | 2/1995 | WIPO . |

OTHER PUBLICATIONS

Fen et al., "Cyclic oxidation of Haynes 230 alloy", Chapman & Hall, pp. 1514–1520 (1992).

Reinshagen and Sikka, "Thermal Spraying of Selected Aluminides", Proceedings of the Fourth National Thermal Spray Conference, Pittsburgh, PA USA, pp. 307–313 (4–10 May 1991).

Kutner, "Thermal spray by design", Reprint from Advanced Materials & Processes Incorporating Metal Progress, Oct. (1988).

(List continued on next page.)

*Primary Examiner*—Teresa J. Walberg
*Assistant Examiner*—Sam Paik
*Attorney, Agent, or Firm*—James T. Moore; James E. Schardt; Charles E. B. Glenn

[57] ABSTRACT

A provided heater comprises a supporting hub and a plurality of electrically resistive heater blades defining a receptacle to receive an inserted cigarette. Each blade comprises a first heater blade leg having a first end and a second end and extending at the first end from the supporting hub, a second heater blade leg having a first end and a second end, and a connecting section connecting the second end of the first leg and the first end of the second leg. The second end of the second leg extends toward the supporting hub and is electrically insulated therefrom. A resistive heating circuit is formed to heat the electrically resistive heater blade which in turn heats the inserted cigarette. The first and second legs are separated by a gap to permit entrainment of flavor substances into the heated cigarette upon drawing by a smoker.

44 Claims, 12 Drawing Sheets

OTHER PUBLICATIONS

"Characterizing Thermal Spray Coatings", Article based on presentations made at the Fourth National Thermal Spray Conference, 4–10 May (1991) and appearing in Advanced Materials and Processes, May 1992, pp. 23–27.

Howes, Jr., "Computerized Plasma Control for Applying Medical–Quality Coatings", Industrial Heating, pp. 22–25, Aug., 1993.

V. Sikka, "Processing of Intermetallic Aluminides", Intermetallic Metallurgy and Processing Intermetallic Compounds, ed. Stoloff et al., Van Mestrand Reinhold, N.Y., 1994.

HEATER FOR USE IN AN ELECTRICAL SMOKING SYSTEM

CROSS REFERENCE TO RELATED APPLICATIONS

The present application is a continuation-in-part of commonly assigned patent application 08/380,718, filed Jan. 30, 1995, which in turn is a continuation of patent application 08/118,665, filed Sep. 10, 1993, now U.S. Pat. No. 5,388,594 issued Feb. 14, 1995 and is a continuation-in-part of commonly assigned patent application Ser. No. 07/943,504, filed Sep. 11, 1992, now U.S. pat. No. 5,505,214 which in turn is a continuation-in-part of patent application Ser. No. 07/666,926 filed Mar. 11, 1991, now abandoned in favor of filewrapper continuation application Ser. No. 08/012,799, filed Feb. 2, 1993, which is now U.S. Pat. No. 5,249,586 issued Oct. 5, 1993.

The present application relates to commonly assigned copending patent applications Ser. No. 07/943,747, filed Sep. 11, 1992; Ser. No. 08/224,848, filed Apr. 8, 1994; and Ser. No. 08/333,470, filed Nov. 2, 1994, and to commonly assigned U.S. Pat. No. 5,060,671, issued Oct. 29, 1991; U.S. Pat. No. 5,095,921, issued Mar. 17, 1992; and U.S. Pat. No. 5,224,498, issued Jul. 6, 1992.

The present application further relates to commonly assigned, copending U.S. patent applications Ser. No. 08/365,952 filed Dec. 29, 1994, to Ser. Nos. 08/425,166 and 08/425,837, now U.S. Pat. No. 5,499,636, filed concurrently herewith, entitled "Cigarette for Electrical Smoking System" (Attorney Docket Nos. PM 1759A and PM 1759B, respectively), and to Ser. No. 08/426,006, filed concurrently herewith, entitled "Iron Aluminide Alloys Useful as Electrical Resistance Heating Elements" (Attorney Docket No. PM 1769).

All of these referenced and related patents and applications are hereby incorporated by reference in their entireties.

BACKGROUND OF THE INVENTION

1. Technical Field of the Invention

The present invention relates generally to heaters for use in an electrical smoking system and more particularly to a heater having a free end for use in an electrical smoking system.

2. Discussion of the Related Art

Previously known conventional smoking devices deliver flavor and aroma to the user as a result of combustion of tobacco. A mass of combustible material, primarily tobacco, is oxidized as the result of applied heat with typical combustion temperatures in a conventional cigarette being in excess of 800° C. during puffing. Heat is drawn through an adjacent mass of tobacco by drawing on the mouth end. During this heating, inefficient oxidation of the combustible material takes place and yields various distillation and pyrolysis products. As these products are drawn through the body of the smoking device toward the mouth of the user, they cool and condense to form an aerosol or vapor which gives the consumer the flavor and aroma associated with smoking.

Conventional cigarettes have various perceived drawbacks associated with them. Among them is the production of sidestream smoke during smoldering between puffs, which may be objectionable to some non-smokers. Also, once lit, they must be fully consumed or be discarded. Relighting a conventional cigarette is possible but is usually an unattractive prospect for subjective reasons (flavor, taste, odor) to a discerning smoker.

A prior alternative to the more conventional cigarettes include those in which the combustible material itself does not directly provide the flavorants to the aerosol inhaled by the smoker. In these smoking articles, a combustible heating element, typically carbonaceous in nature, is combusted to heat air as it is drawn over the heating element and through a zone which contains heat-activated elements that release a flavored aerosol. While this type of smoking device produces little or no sidestream smoke, it still generates products of combustion, and once lit it is not adapted to be snuffed for future use in the conventional sense.

In both the more conventional and carbon element heated smoking devices described above combustion takes place during their use. This process naturally gives rise to many by-products as the combusted material breaks down and interacts with the surrounding atmosphere.

Commonly assigned U.S. Pat. Nos. 5,093,894; 5,225,498; 5,060,671 and 5,095,921 disclose various electrical resistive heating elements and flavor generating systems which significantly reduce sidestream smoke while permitting the smoker to selectively suspend and reinitiate smoking. However, the cigarette articles disclosed in these patents are not very durable and may collapse, tear or break from extended or heavy handling. In certain circumstances, these prior cigarette articles may crush as they are inserted into the electric lighters. Once they are smoked, they are even weaker and may tear or break as they are removed from the lighter.

U.S. patent application Ser. No. 08/380,718, filed Jan. 30, 1995 and U.S. Pat. No. 5,388,594, issued Feb. 14, 1995 describe an electrical smoking system including a novel electrically powered lighter and novel cigarette that is adapted to cooperate with the lighter. The preferred embodiment of the lighter includes a plurality of metallic sinusoidal heaters disposed in a configuration that slidingly receives a tobacco rod portion of the cigarette.

The preferred embodiment of the cigarette of Ser. No. 08/380,718 and U.S. Pat. No. 5,388,594 preferably comprises a tobacco-laden tubular carrier, cigarette paper overwrapped about the tubular carrier, an arrangement of flow-through filter plugs at a mouthpiece end of the carrier and a filter plug at the opposite (distal) end of the carrier, which preferably limits air flow axially through the cigarette. The cigarette and the lighter are configured such that when the cigarette is inserted into the lighter and as individual heaters are activated for each puff, localized charring occurs at spots about the cigarette in the locality where each heater was bearing against the cigarette. Once all the heaters have been activated, these charred spots are closely spaced from one another and encircle a central portion of the carrier portion of the cigarette. Depending on the maximum temperatures and total energies delivered at the heaters, the charred spots manifest more than mere discolorations of the cigarette paper. In most applications, the charring will create at least minute breaks in the cigarette paper and the underlying carrier material, which breaks tends to mechanically weaken the cigarette. For the cigarette to be withdrawn from the lighter, the charred spots must be at least partially slid past the heaters. In aggravated circumstances, such as when the cigarette is wet or toyed with or twisted, the cigarette may be prone to break or leave pieces upon its withdrawal from the lighter. Pieces left in the lighter fixture can interfere with the proper operation of the lighter and/or deliver an off-taste to the smoke of the next cigarette. If the cigarette breaks in two while being withdrawn, the smoker may be faced not only with the frustration of failed cigarette product, but also with the prospect of clearing debris from a clogged lighter before he or she can enjoy another cigarette.

The preferred embodiment of the cigarette of Ser. No. 08/380,718 and U.S. Pat. No. 5,388,594 is essentially a hollow tube between the filter plugs at the mouthpiece end of the cigarette and the plug at the distal end. This construction is believed to elevate delivery to the smoker by providing sufficient space into which aerosol can evolve off the carrier with minimal impingement and condensation of the aerosol on any nearby surfaces.

Several proposals have been advanced which significantly reduce undesired sidestream smoke while permitting the smoker to suspend smoking of the article for a desired period and then to resume smoking. For example, commonly assigned U.S. Pat. Nos. 5,093,894; 5,225,498; 5,060,671 and 5,095,921 disclose various heating elements and flavor generating systems. Parent application Ser. No. 08/380,718 and U.S. Pat. No. 5,388,594 disclose an electrical smoking system having heaters which are actuated upon sensing of a draw by control and logic circuitry. The heaters are preferably a relatively thin serpentine structure to transfer adequate amounts of heat to the cigarette and is lightweight.

Although these devices and heaters overcome the observed problems and achieve the stated objectives, many embodiments are subject to mechanical weakening and possible failure due to stresses induced by inserting and removing the cylindrical tobacco medium and also by adjusting or toying with the inserted cigarette.

Further, undesired electrical shorts can occur if the shape of a heater assembly is altered, e.g., by adjusting or toying with the inserted cigarette.

Also, the electrical smoking systems employ electrically resistive heaters which have necessitated relatively complex electrical connections which can be disturbed by insertion and removal of the cigarette.

OBJECTS OF THE INVENTION

It is accordingly an object of the present invention to provide a heater which generates smoke from a tobacco medium without sustained combustion.

It is another object of the present invention to provide a heater for a smoking article which reduces the creation of undesired sidestream smoke.

It is yet another object of the present invention to provide a heater for a smoking article which permits the smoker to suspend and resume use.

It is a further object of the present invention to accomplish the foregoing objects while improving aerosol generation within the smoking system.

It is yet another object of the present invention to provide a heater structure which provides a desired number of puffs and which is straightforwardly modified to change the number and/or duration of puffs provided without sacrificing subjective qualities of the tobacco.

It is a further object of the present invention to provide a heating element for a smoking article which is mechanically suitable for insertion and removal of a cigarette.

It is another object of the present invention to simplify connections of an electrically resistive heater to an associated power source.

It is a further object of the present invention to provide a heating element for a smoking article which is mechanically stable during heating cycles.

It is another object of the present invention to minimize variation of an interface between the heating element and the cigarette to avoid changes in heat transfer.

It is a further object of the present invention to provide such a heater which is more economical to manufacture.

It is another object of the present invention to accomplish the foregoing objects simply and in a straightforward manner.

It is another object of the present invention to provide a method of making such a heater to accomplish the foregoing objects.

Additional objects and advantages of the present invention are apparent from the drawings and specification which follow.

SUMMARY OF THE INVENTION

The foregoing and additional objects are obtained by a heater according to the present invention. The heater comprises a supporting hub and a plurality of electrically resistive heater blades defining a receptacle to receive an inserted cigarette. Each blade comprises a first heater blade leg having a first end and a second end and extending at the first end from the supporting hub, a second heater blade leg having a first end and a second end, and a connecting section connecting the second end of the first leg and the first end of the second leg. The second end of the second leg extends toward the supporting hub and is electrically insulated therefrom. A resistive heating circuit is formed to heat the electrically resistive heater blade which in turn heats the inserted cigarette. The first and second legs are separated by a gap to permit entrainment of air to aid in evolving flavor substances from the heated cigarette upon drawing by a smoker.

DETAILED DESCRIPTION OF THE PREFERRED EMBODIMENTS

Figure 1:
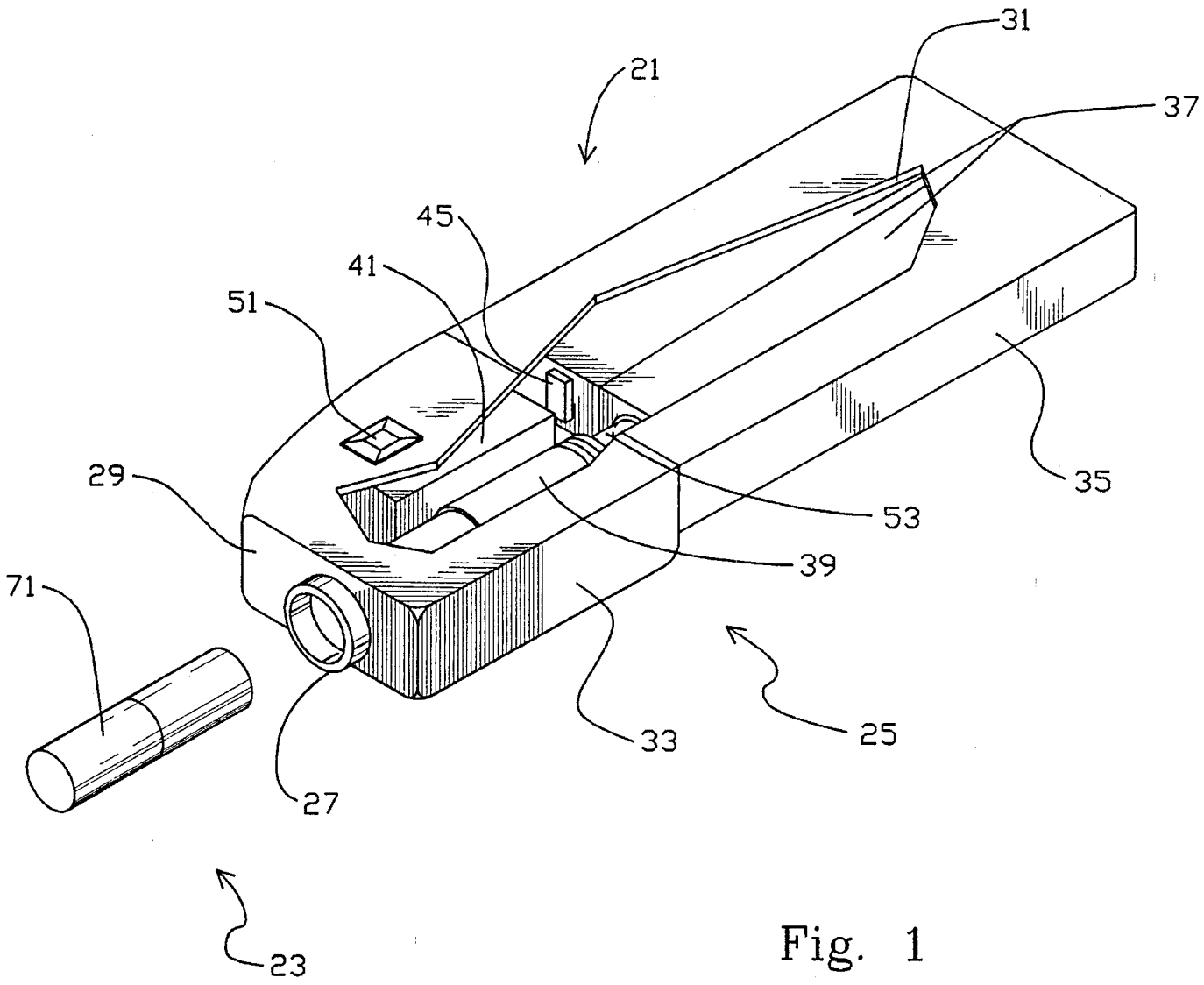
FIG. 1 is a partially exposed perspective view of an electrical smoking system employing a heater according to the present invention.
Figure 2:
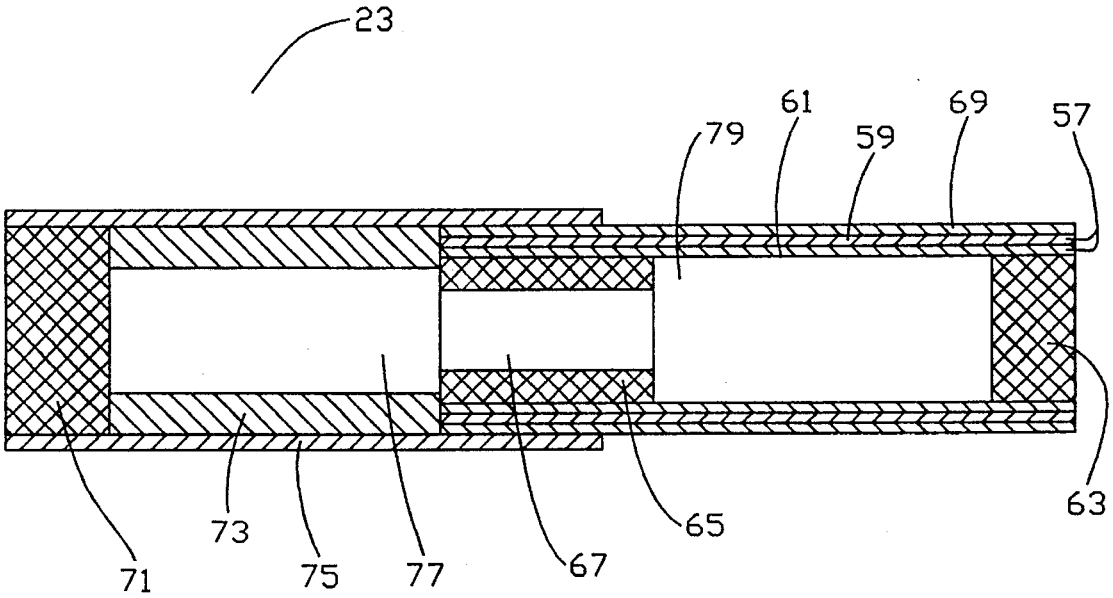
FIG. 2 is a side, cross-sectional view of a cigarette used in conjunction with the present invention.

A smoking system 21 according to the present invention is generally seen with reference to FIGS. 1 and 2, and is described in greater detail in parent application Ser. No. 08/380,718, filed Jan. 30, 1995 and U.S. Pat. No. 5,388,594, which are hereby incorporated by reference in its entirety. The present invention is discussed in greater detail with reference to FIGS. 3–14.

The smoking system 21 includes a cylindrical aerosol generating tube or cigarette 23 and a reusable lighter 25. The cigarette 23 is adapted to be inserted in and removed from an orifice 27 at a front end 29 of the lighter 25. The smoking system 21 is used in much the same fashion as a conventional cigarette. The cigarette 23 is disposed of after one or more puff cycles. The lighter 25 is preferably disposed of after a greater number of puff cycles than the cigarette 23.

The lighter 25 includes a housing 31 and has front and rear portions 33 and 35. A power source 37 for supplying energy to heating elements for heating the cigarette 23 is preferably disposed in the rear portion 35 of the lighter 25. The rear portion 35 is preferably adapted to be easily opened and closed, such as with screws or with snap-fit components, to facilitate replacement of the power source 37. The front portion 33 preferably houses heating elements and circuitry in electrical communication with the power source 37 in the rear portion 35. The front portion 33 is preferably easily joined to the rear portion 35, such as with a dovetail joint or by a socket fit. The housing 31 is preferably made from a hard, heat-resistant material. Preferred materials include metal-based or, more preferably, polymer-based materials. The housing 31 is preferably adapted to fit comfortably in the hand of a smoker and, in a presently preferred embodiment, has overall dimensions of 10.7 cm by 3.8 cm by 1.5 cm.

The power source 37 is sized to provide sufficient power for heating elements that heat the cigarette 23. The power source 37 is preferably replaceable and rechargeable and may include devices such as a capacitor, or more preferably, a battery. In a presently preferred embodiment, the power source is a replaceable, rechargeable battery such as four nickel cadmium battery cells connected in series with a total, non-loaded voltage of approximately 4.8 to 5.6 volts. The characteristics required of the power source 37 are, however, selected in view of the characteristics of other components in the smoking system 21, particularly the characteristics of the heating elements. U.S. Pat. No. 5,144,962 describes several forms of power sources useful in connection with the smoking system of the present invention, such as rechargeable battery sources and quick-discharging capacitor power sources that are charged by batteries, and is hereby incorporated by reference.

Figure 3:
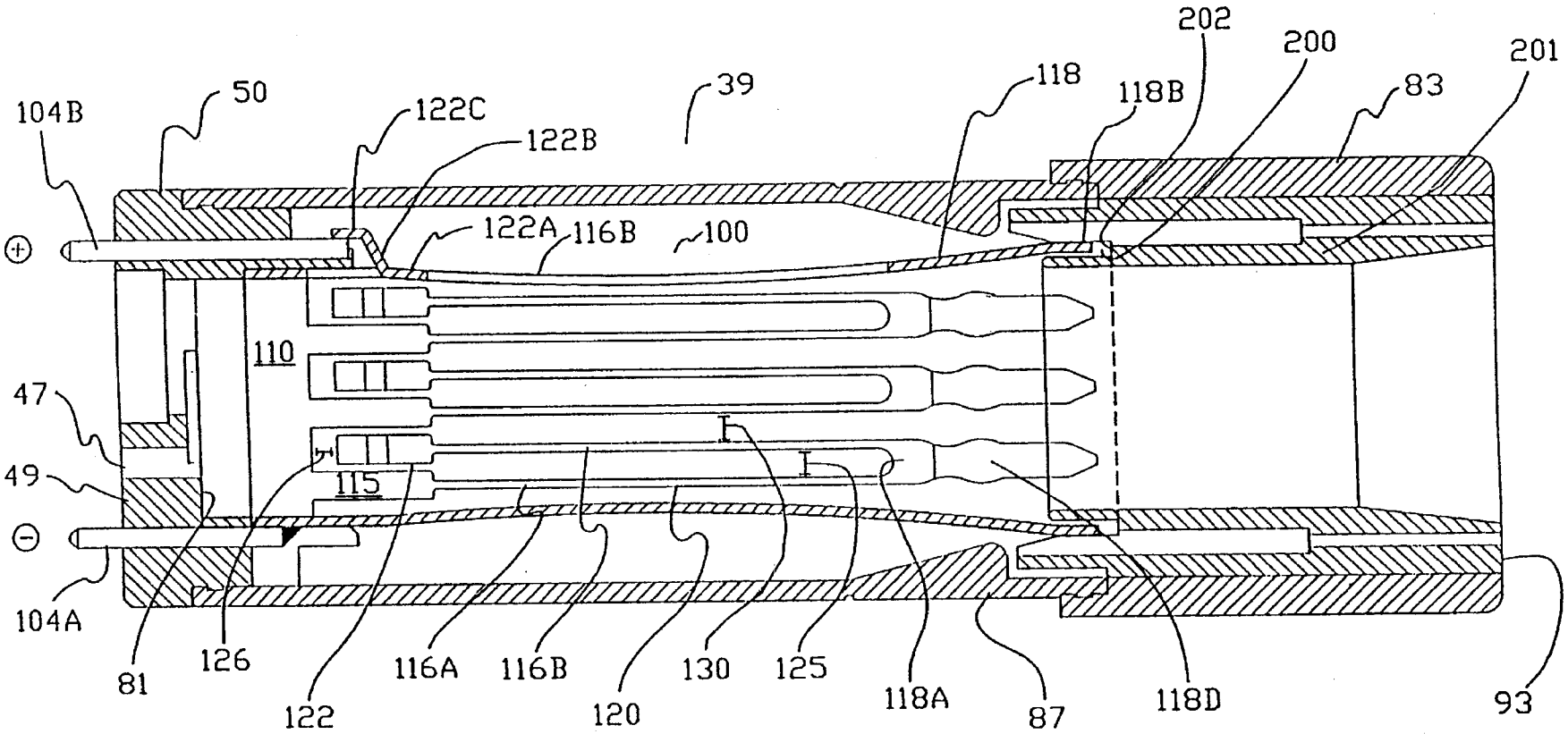
FIG. 3 is a side, cross-sectional view of a heater fixture according to the present invention.

A substantially cylindrical heating fixture 39 for heating the cigarette 23, and, preferably, for holding the cigarette in place relative to the lighter 25, and electrical control circuitry 41 for delivering a predetermined amount of energy from the power source 37 to heating elements (not seen in FIGS. 1 and 2) of the heating fixture are preferably disposed in the front 33 of the lighter. As described in greater detail below, a generally circular, terminal end hub 110 is fixed, e.g., welded, to be disposed within the interior of heater fixture 39, e.g., is fixed to spacer 49, as shown in FIG. 3. In the presently preferred embodiment, the heating fixture 39 includes a plurality of radially spaced heating blades 120 supported to extend from the hub, seen in FIG. 3 and described in greater detail below, that are individually energized by the power source 37 under the control of the circuitry 41 to heat a number of, e.g., eight, areas around the periphery of the inserted cigarette 23. Eight heating blades 120 are preferred to develop eight puffs as in a conventional cigarette and eight heater elements also lend themselves to electrical control with binary devices. A desired number of puffs can be generated, e.g., any number between 5–16, and preferably 6–10 or 8, per inserted cigarette. As discussed below, the number of heater blades can exceed the desired number of puffs/cigarette.

The circuitry 41 is preferably activated by a puff-actuated sensor 45, seen in FIG. 1, that is sensitive either to pressure drops that occur when a smoker draws on the cigarette 23. The puff-actuated sensor 45 is preferably disposed in the front 33 of the lighter 25 and communicates with a space inside the heater fixture 39 and near the cigarette 23 through a passageway extending through a spacer and a base of the heater fixture and, if desired, a puff sensor tube (not shown). A puff-actuated sensor 45 suitable for use in the smoking system 21 is described in U.S. Pat. No. 5,060,671, the disclosure of which is incorporated by reference, and is in the form of a Model 163PCO1D35 silicon sensor, manufactured by the MicroSwitch division of Honeywell, Inc., Freeport, Ill., which activates an appropriate one of the heater blades 120 as a result of a change in pressure when a smoker draws on the cigarette 23. Flow sensing devices, such as those using hot-wire anemometry principles, have also been successfully demonstrated to be useful for activating an appropriate one of the heater blades 120 upon detection of a change in air flow.

An indicator 51 is preferably provided on the exterior of the lighter 25, preferably on the front 33, to indicate the number of puffs remaining on a cigarette 23 inserted in the lighter. The indicator 51 preferably includes a seven-segment liquid crystal display. In a presently preferred embodiment, the indicator 51 displays the digit "8" for use with an eight-puff cigarette when a light beam emitted by a light sensor 53, seen in FIG. 1, is reflected off of the front of a newly inserted cigarette 23 and detected by the light sensor. The light sensor 53 is preferably mounted in an opening in the spacer and the base of the heater fixture 39. The light sensor 53 provides a signal to the circuitry 41 which, in turn, provides a signal to the indicator 51. For example, the display of the digit "8" on the indicator 51 reflects that the preferred eight puffs provided on each cigarette 23 are available, i.e., none of the heater elements 43 have been activated to heat the new cigarette. After the cigarette 23 is fully smoked, the indicator displays the digit "0". When the cigarette 23 is removed from the lighter 25, the light sensor 53 does not detect the presence of a cigarette 23 and the indicator 51 is turned off. The light sensor 53 is modulated so that it does not constantly emit a light beam and provide an unnecessary drain on the power source 37. A presently preferred light sensor 53 suitable for use with the smoking system 21 is a Type OPR5005 Light Sensor, manufactured by OPTEX Technology, Inc., 1215 West Crosby Road, Carrollton, Tex. 75006.

As one of several possible alternatives to using the abovenoted light sensor 53, a mechanical switch (not shown) may be provided to detect the presence or absence of a cigarette 23 and a reset button (not shown) may be provided for resetting the circuitry 41 when a new cigarette is inserted in the lighter 25, e.g., to cause the indicator 51 to display the digit "8", etc. Power sources, circuitry, puff-actuated sensors, and indicators useful with the smoking system 21 of the present invention are described in U.S. Pat. No. 5,060,671 and U.S. patent application Ser. No. 07/943,504, both of which are incorporated by reference. The passageway and the opening 50 in the spacer and the heater fixture base are preferably air-tight during smoking.

A presently preferred cigarette 23 for use with the smoking system 21 will now be described and is shown in greater detail in parent application Ser. No. 08/380,718, filed Jan. 30, 1995 and U.S. Pat. No. 5,388,594, and Ser. Nos. 08/425,166 and 08/425,837, now U.S. Pat. No. 5,499,636, filed concurrently herewith, entitled "Cigarette for Electrical Smoking System" (Attorney Docket Nos. PM 1759A and PM 1759B, respectively), which are hereby incorporated by reference in their entireties, although the cigarette may be in any desired form capable of generating a flavored tobacco response for delivery to a smoker when the cigarette is heated by the heating elements 122. Referring to FIG. 2, the cigarette 23 includes a tobacco web 57 formed of a carrier or plenum 59 which supports tobacco flavor material 61, preferably including tobacco. The tobacco web 57 is wrapped around and supported by an optional cylindrical back-flow filter 63 at one end and a cylindrical first free-flow filter 65 at an opposite end. The first free-flow filter 65 is preferably an "open-tube" type filter having a longitudinal passage 67 extending through the center of the first free-flow filter and, hence, provides a low resistance to draw or free flow.

If desired, cigarette overwrap paper 69 is wrapped around the tobacco web 57. Types of paper useful as the overwrap paper 69 include a low basis weight paper, preferably a paper with a tobacco flavor coating, or a tobacco-based paper to enhance the tobacco flavor of a flavored tobacco response. A concentrated extract liquor in full or diluted strength may be coated on the overwrap paper 69. The overwrap paper 69 preferably possesses a minimal base weight and caliper while providing sufficient tensile strength for machine processes. Presently preferred characteristics of a tobacco-based paper include a basis weight (at 60% relative humidity) of between 20–25 grams/m$^2$, minimum permeability of 0–25 CORESTA (defined as the amount of air, measured in cubic centimeters, that passes through one square centimeter of material, e.g., a paper sheet, in one minute at a pressure drop of 1.0 kilopascal), tensile strength $\geqq$2000 grams/27 mm width (1 in/min), caliper 1.3–1.5 mils, $CaCO_3$ content $\leqq$5%, citrate 0%. Materials for forming the overwrap paper 69 preferably include $\geqq$75% tobacco-based sheet (non-cigar, flue- or flue-/air-cured mix filler and bright stem). Flax fiber in amounts no greater than that necessary to obtain adequate tensile strength may be added. The overwrap paper 69 can also be conventional flax fiber paper of basis weight 15–20 g/m$^2$ or such paper with an extract coating. Binder in the form of citrus pectin may be added in amounts less than or equal to 1%. Glycerin in amounts no greater than necessary to obtain paper stiffness similar to that of conventional cigarette paper may be added.

The cigarette 23 also preferably includes a cylindrical mouthpiece filter 71, which is preferably a conventional RTD-type (Resistance To Draw) filter, and a cylindrical second free-flow filter 73. The mouthpiece filter and the second free-flow filter are secured to one another by tipping paper 75. The tipping paper 75 extends past an end of the second free-flow filter 73 and is attached to the overwrap paper 69 to secure an end of the first free-flow filter 65 in position adjacent an end of the second free-flow filter 73. Like the first free-flow filter 65, the second free-flow filter 73 is preferably formed with a longitudinal passage 77 extending through its center. The back-flow filter 63 and the first free-flow filter 65 define, with the tobacco web 57, a cavity 79 within the cigarette 23.

It is preferred that the inside diameter of the longitudinal passage 77 of the second free-flow filter 73 be larger than the inside diameter of the longitudinal passage 67 of the first free-flow filter 65. Presently preferred inside diameters for the longitudinal passage 67 are between 1–4 mm and for the longitudinal passage 77 are between 2–6 mm. It has been observed that the different inside diameters of the passages 67 and 77 facilitates development of a desirable mixing or turbulence between the aerosol developed from the heated tobacco flavor material and air drawn in from outside the cigarette 23 during drawing on the cigarette, resulting in an improved flavored tobacco response and facilitating exposure of more of an end of the mouthpiece filter 71 to the mixed aerosol. The flavored tobacco response developed by heating the tobacco flavor material 61 is understood to be primarily in a vapor phase in the cavity 79 and to turn into a visible aerosol upon mixing in the passage 77. In addition to the above-described first free-flow filter 65 having a longitudinal passage 67, other arrangements capable of generating the desired mixing of the vapor phase flavored tobacco response with introduced air include those in which a first free-flow filter is provided in the form of a filter having a multitude of small orifices, i.e., the first free-flow filter may be in the form of a honeycomb or a metal plate having multiple holes formed therein.

Air is preferably drawn into the cigarette 23 predominantly through the tobacco web 57 and the overwrap paper 69, in a transverse or radial path, and not through the back-flow filter 63 in a longitudinal path. It is desirable to permit air flow through the back-flow filter 63 during a first puff on the cigarette to lower the RTD. It is presently understood that drawing air into the cigarette 23 longitudinally tends to result in the aerosol developed by heating the tobacco web with the heater blades 120 arranged radially around the tobacco web not being properly removed from the cavity 79. It is presently preferred to produce a flavored tobacco response as a function almost entirely of the makeup of the tobacco web 57 and the energy level of the heater blades 120. Accordingly, the portion of the air flow through the cigarette resulting from longitudinal flow through the backflow filter 63 is preferably minimal during smoking, except during the first puff. Further, the back-flow filter 63 preferably minimizes the flow of aerosol in a backward direction out of the cavity 79 after heating of the tobacco flavor material 61, so that the potential for damage to components of the lighter 25 from aerosol flowing backward from the cigarette 23 is minimized.

The carrier or plenum 59 which supports the tobacco flavor material provides a separation between the heater blades 120 and the flavor material, transfers heat generated by the heater elements to the flavor material, and maintains cohesion of the cigarette after smoking. Example carriers are discussed in greater detail in U.S. patent application Ser. No.

07/943,504 and copending commonly-assigned U.S. patent application Ser. No. 07/943,747, filed Sep. 11, 1992, which are incorporated by reference in their entireties.

A presently preferred tobacco web 57 is formed using a paper making-type process. In this process, tobacco strip is washed with water. The solubles are used in a later coating step. The remaining (extracted) tobacco fiber is used in the construction of a base mat. in one embodiment, carbon fibers are dispersed in water. Sodium alginate is added to the water. Any other hydrocolloid which does not interfere with the flavored tobacco response, is water soluble, and has a suitable molecular weight to impart strength to the tobacco web 57 may be added in lieu of the sodium alginate. The dispersion is mixed with the slurry of extracted tobacco fibers and optional flavors. The resultant mixture is wet-laid onto a fourdrinier wire and the web is passed along the remainder of a traditional paper making machine to form a base web. The solubles removed by washing the tobacco strip are coated onto one side of the base web, preferably by a standard reverse roll coater located after a drum or Yankee dryer. The tobacco solubles/tobacco dust or particulate ratio is preferably varied between a 1:1 and a 20:1 ratio. The slurry may also be cast or extruded onto the base mat. Alternatively, the coating step is produced off-line. During or after the coating step, flavors that are conventional in the cigarette industry are added. Pectin or another hydrocolloid is added, preferably in a range of between 0.1 to 2.0%, to improve the coatability of the slurry.

Whichever type of carrier 59 is used, tobacco flavor material 61 which is disposed on the inner surface of the carrier liberates flavors when heated and is able to adhere to the surface of the carrier. Such materials include continuous sheets, foams, gels, dried slurries, or dried spray-deposited slurries, which preferably, although not necessarily, contain tobacco or tobacco-derived materials, and which are more fully discussed in the above-incorporated U.S. patent application Ser. No. 07/943,747.

Preferably, a humectant, such as glycerin or propylene glycol, is added to the tobacco web 57 during processing in amounts equalling between 0.5% and 10% of humectant by the weight of the web. The humectant facilitates formation of a visible aerosol by acting as an aerosol precursor. When a smoker exhales an aerosol containing the flavored tobacco response and the humectant, the humectant condenses in the atmosphere, and the condensed humectant provides the appearance of conventional cigarette smoke.

The cigarette 23 is preferably a substantially constant diameter along its length and, like conventional cigarettes, is preferably between approximately 7.5 mm and 8.5 mm in diameter so that a smoker has a similar "mouth feel" with the smoking system 21 as with a conventional cigarette. In the presently preferred embodiment, the cigarette 23 is 58 mm in length, overall, thereby facilitating the use of conventional packaging machines in the packaging of such cigarettes. The combined length of the mouthpiece filter 71 and the second free-flow filter 73 is preferably 30 mm. The tipping paper 75 preferably extends 5 mm past the end of the second free-flow filter 73 and over the tobacco web 57. The length of the tobacco web 57 is preferably 28 mm. The tobacco web 57 is supported at opposite ends by the back-flow filter 63 which is preferably 7 mm in length, and the first free-flow filter 65, which is preferably 7 mm in length. The cavity 79 defined by the tobacco web 57, the back-flow filter 63, and the first free-flow filter 65 is preferably 14 mm in length.

When the cigarette 23 is inserted in the orifice 27 in the first end 29 of the lighter 25, it abuts or nearly abuts an inner bottom surface 81 of the heater fixture at hub 110, seen in FIG. 3, adjacent the passageway 47 communicating with the puff-actuated sensor 45 and the opening 55 for the light sensor 53. In this position, the cavity 79 of the cigarette 23 is preferably adjacent the heater blades 120 and substantially all of that portion of the cigarette including the second free-flow filter 73 and the mouthpiece filter 71 extends outside of the lighter 25. Portions of the heater blades 120 are preferably biased radially inward to facilitate holding the cigarette 23 in position relative to the lighter 25 and so that they are in a thermal transfer relationship with the tobacco web 57, either directly or through the overwrap paper 69. Accordingly, the cigarette 23 is preferably compressible to facilitate permitting the heater blades 120 to press into the sides of the cigarette. The remaining elements of heater fixture are identical to these described in grandparent application Ser. No. 07/943,504.

Air flow through the cigarette 23 is accomplished in several ways. For example, in the embodiment of the cigarette 23 shown in FIG. 2, the overwrap paper 69 and the tobacco web 57 are sufficiently air permeable to obtain a desired RTD such that, when a smoker draws on the cigarette, air flows into the cavity 79 transversely or radially through the overwrap paper and the tobacco web. As noted above, an air-permeable back-flow filter 69 may be used to provide longitudinal air flow into the cavity 79.

If desired, transverse air flow into the cavity 79 is facilitated by providing a series of radial perforations (not shown) through the overwrap paper 69 and the tobacco web 57 in one or more regions adjacent the cavity. Such perforations have been observed to improve the flavored tobacco response and aerosol formation. Perforations having a density of approximately 1 hole per 1–2 square millimeters and a hole diameter of between 0.4 mm and 0.7 mm are provided through the tobacco web 57. This results in preferred CORESTA porosity of between 100–500. The overwrap paper 69, after perforation, preferably has a permeability of between 100 and 1000 CORESTA. Of course, to achieve desired smoking characteristics, such as resistance to draw, perforation densities and associated hole diameters other than those described above may be used.

Transverse air flow into the cavity 79 is also facilitated by providing perforations (not shown) through both the overwrap paper 69 and the tobacco web 57. In forming a cigarette 23 having such perforations, the overwrap paper 69 and the tobacco web 57 are attached to one another and then perforated together or are perforated separately and attached to one another such that the perforations in each align or overlap.

Presently preferred heater embodiments are show in FIGS. 3–14. These heaters provide improved mechanical strength for the repeated insertions, adjustments and removals of cigarettes 23 and significantly improve the generation of aerosols from a heated cigarette while maintaining energy requirements. It has been found that the generated aerosols tend to flow radially inward away from a pulsed heater.

Generally, there are preferably eight heater blades 120 to provide eight puffs upon sequential firing of the heater blades 120, thereby simulating the puff count of a conventional cigarette. Specifically, the heater blades 120 extend from hub 110 to form a cylindrical arrangement of heater blades to receive an inserted cigarette 23. Preferably, a gap 130 is defined between adjacent heater blades 120.

It may be desired to change the number of puffs, and hence the number of heater blades 120, achieved when a cigarette is inserted into the cylindrical receptacle CR. This desired number is achieved by forming a desired number of heater blades 120. This can be achieved by providing equally or unequally sized blades.

The heater fixture is disposed in the orifice 27 in the lighter 25. The cigarette 23 is inserted, optional back-flow filter 63 first, in the orifice 27 in the lighter 25 into a substantially cylindrical space of the heater fixture 39 defined by a ring-shaped cap 83 having an open end for receiving the cigarette, a cylindrical air channel sleeve 87, a heater assembly 100 including the heater blades 120, an electrically conductive pin or common lead 104A, which serves as a common lead for the heater elements of the heater assembly, electrically conductive positive pins or leads 104B, and the spacer. The bottom inner surface 81 of the spacer stops the cigarette 23 in a desired position in the heater fixture 39 such that the heater blades 120 are disposed adjacent the cavity 79 in the cigarette, and in a preferred embodiment are disposed as described in Ser. No. Nos. 08/425,166 and 08/425,837, now U.S. Pat. No. 5,499,636, filed concurrently herewith, entitled "Cigarette for Electrical Smoking System" (Attorney Docket Nos. PM 1759A and PM 1759B, respectively, which is incorporated by reference in its entirety.

Substantially all of the heater fixture 39 is disposed inside and secured in position by a snug fit with the housing 31 of the front 33 of the lighter 25. A forward edge 93 of the cap 83 is preferably disposed at or extending slightly outside the first end 29 of the lighter 25 and preferably includes an internally beveled or rounded portion to facilitate guiding the cigarette 23 into and out of the heater fixture 39. The pins 104A and 104B are preferably received in corresponding sockets (not shown), thereby providing support for the heater fixture 39 in the lighter 25, and conductors or printed circuits lead from the socket to the various electrical elements. Other pins can provide additional support to strengthen the pin assembly. The pins 104A and 104B can comprise any suitable material and preferably comprise tinned phosphorous bronze. The passageway 47 in the spacer and the base 50 communicates with the puff-actuated sensor 45 and the light sensor 53 senses the presence or absence of a cigarette 23 in the lighter 25.

Figure 4:
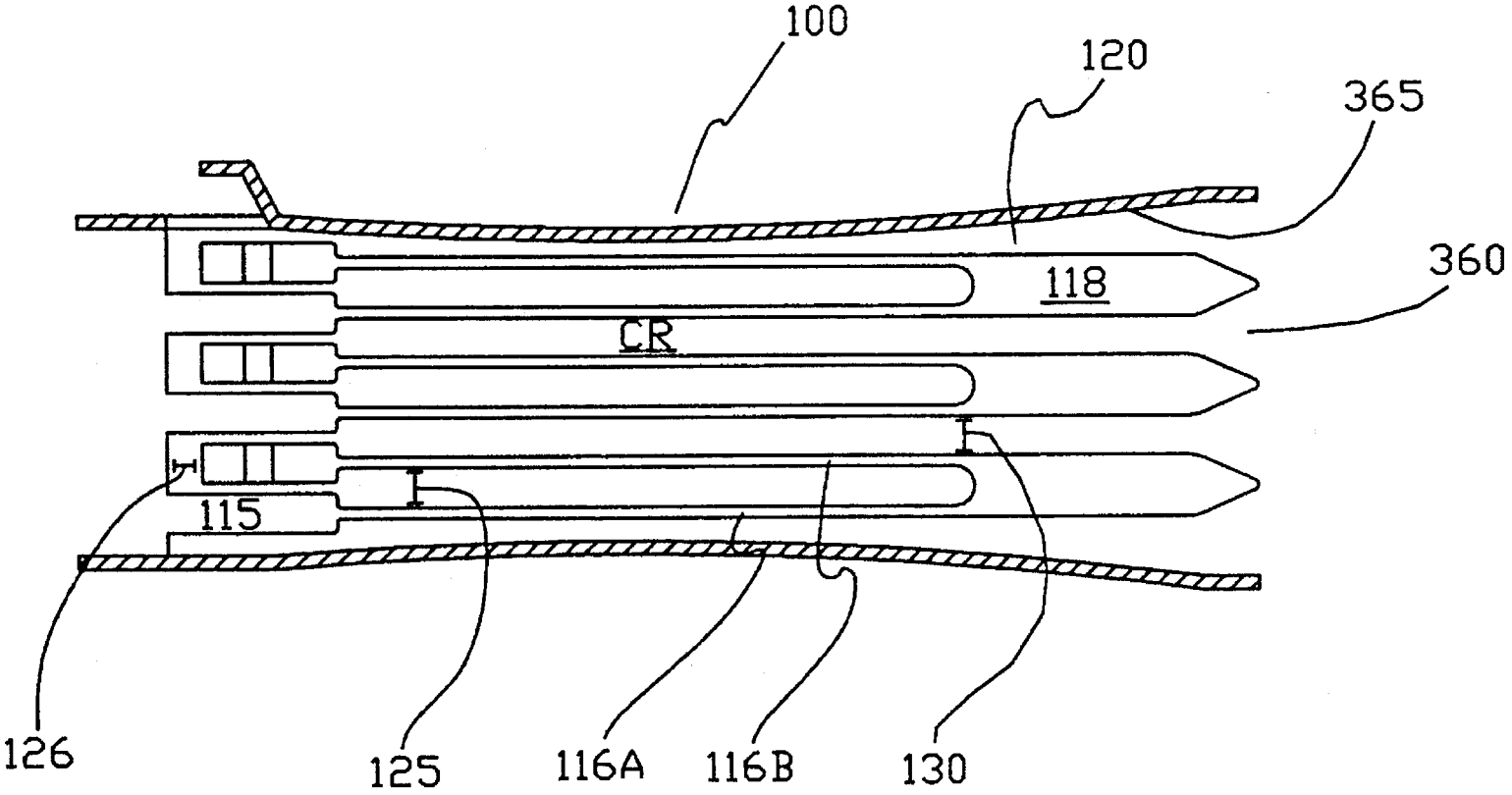
FIG. 4 is a side view of a heater assembly according to the present invention.
Figure 10:
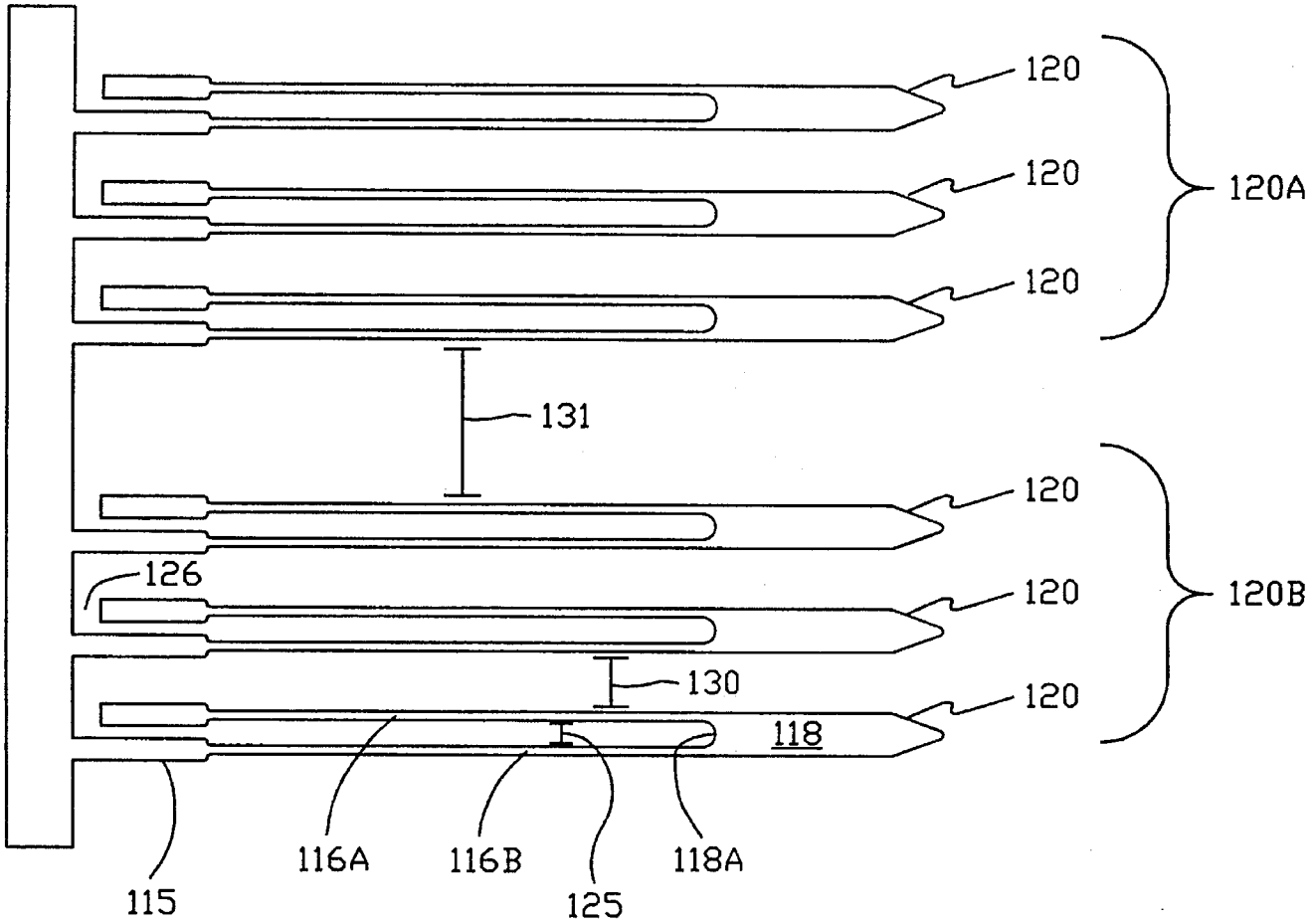
FIG. 10 is a top view of a non-symmetrical arrangement of heater blades in a flat state prior to rolling.

As seen in FIGS. 3 and 4, the heater assembly 100 is preferably a monolithic structure which comprises eight heater blades 120 extending from a central hub 110 in a symmetrical arrangement or, as discussed below in reference to FIG. 10, in a non-symmetrical arrangement. As best seen in FIG. 4, the heater assembly defines a generally circular insertion opening 360 having a throat 365 which directs the inserted cigarette toward the coaxially defined cylindrical receptacle CR having a diameter which is less than insertion opening 360. Insertion opening 360 is defined by respective end portions 118B of the connecting sections 118 of the heater blades 120, and the throat section 365 is defined by the portion of sections 118 between connecting edge 118A and end 118B. Insertion end 360 preferably has a diameter which is greater than the inserted cigarette 23 to guide the cigarette towards the receptacle CR, and the receptacle CR has a diameter approximately equal to cigarette 23 to ensure a snug fit for a good transfer of thermal energy. Cigarette 23 preferably has a diameter which is approximately equal to the range of diameters known in the art. Given acceptable manufacturing tolerances for cigarette 23, the gradually narrowing area or throat 365 in the transition between the distal end and the receptacle CR can also serve to slightly compress the cigarette to increase the thermal contact with the surrounding blades 120 serving as an inner wall of the receptacle. By way of non-limiting example, insertion end 360 preferably has an internal diameter of approximately 0.356 in., ±0.02 in., and receptacle CR preferably has an internal diameter of approximately 0.278 in., ±0.02 in. The blades 120 can be bowed inward to increase thermal contact with the cigarette by constricting the diameter of the cylindrical receptacle.

Each U-shaped heater blade 120 comprises a first section or leg 116A extending at a first end from hub 110, a connecting section 118 connected to an opposite second end of the first section or leg 116A, and a second section or leg 116B extending at a first end from connecting section 118 toward hub 110. First and second legs 116A and 116B are separated by a gap 125 which can be relatively constant, are preferably substantially parallel in any unrolled state as in FIGS. 9 and 10 discussed below, are continuous in the direction of cigarette insertion to reduce undesired snagging of the cigarette and are oriented to define a cylindrical receptacle CR for the inserted cigarette 23. Connecting section 118 has a curved joining edge 118A to join opposing inner edges of the blade legs 116A and 116B such that an elongated U-shaped resistive path is formed which is substantially parallel with the longitudinal axis of the inserted cigarette and extends alongside the cigarette, as discussed in greater detail below. Curved joining edge 118A preferably has a curvature of approximately 180°±20° so that a U-shaped blade is formed and has a curvature which is concave toward the hub 110 and convex toward the insertion opening 360. The first end of first blade leg 116A at hub 110 can have an increased width, with the same approximate thickness, at portion 115 relative to the remainder of first leg 116A to lower the current density and the power density at portion 115 to reduce ohmic heating of portion 115. Also, this widening increases the mechanical integrity of the blade 120 at hub 110.

A second end 122 of second blade leg 116B is preferably elevated relative to the main portion of second blade section 116B in a step shape to facilitate electrical connection with a respective positive pin 104B. More specifically, as shown in FIGS. 3 and 4, end 122 comprises three sections, namely, a section 122A which is a substantially planar continuation of the main section of second blade leg 116B, a transition section 122B which rises at an angle as shown, and a connecting end section 122C which is generally parallel with section 122A. The sections of end 122 can have a wider width than second blade leg 122B for increased strength, to provide an adequate contact area for a positive connection at connecting end section 122C, and to lower the current density and thus the ohmic heating of end 122. End section 122C is preferably tack welded or electrically and mechanically connected by any other technique to positive pin 104B.

Figure 5:
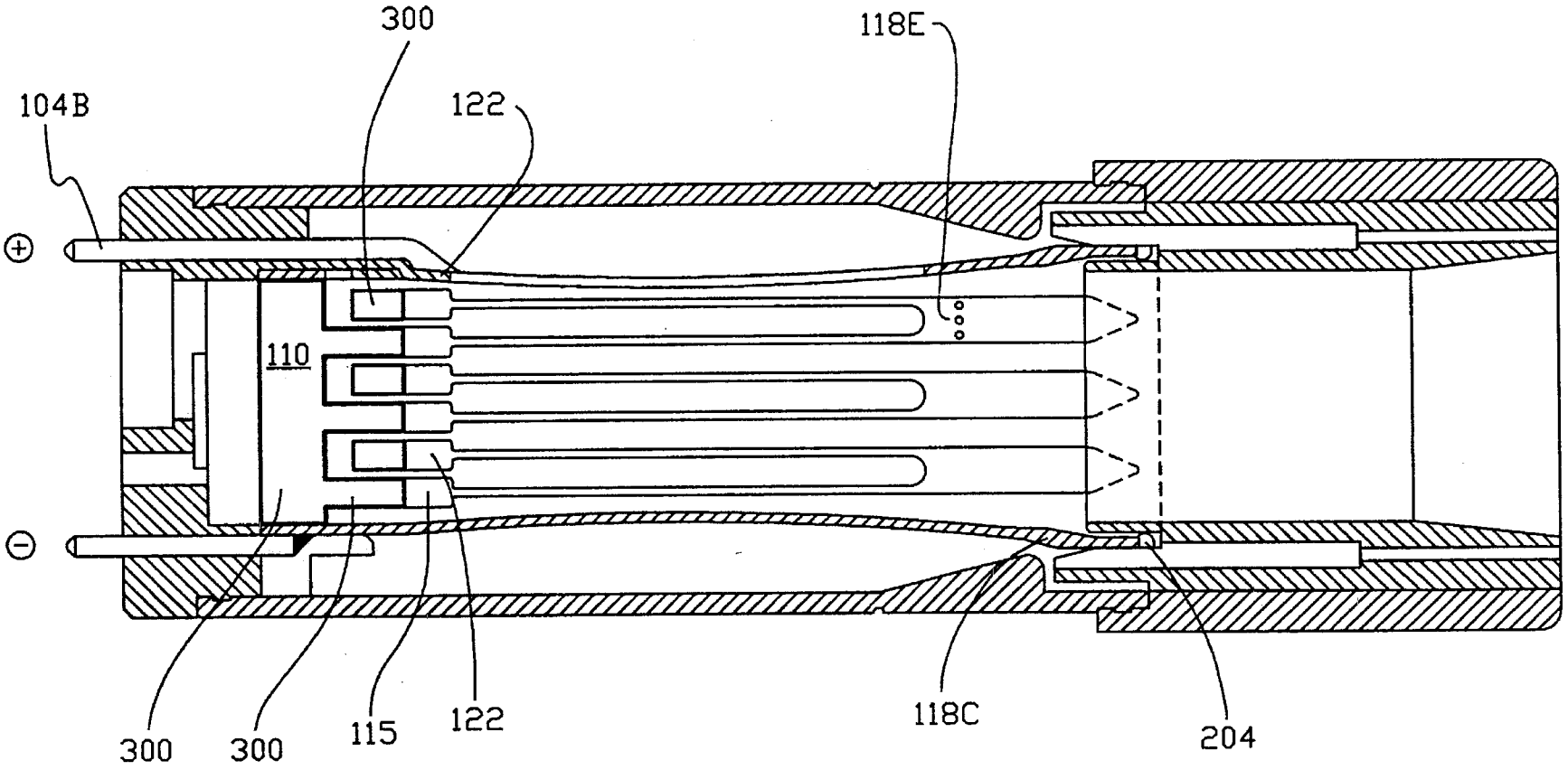
FIG. 5 is a side, cross-sectional view of a heater fixture according to the present invention employing an electrical insulator coating.
Figure 6:
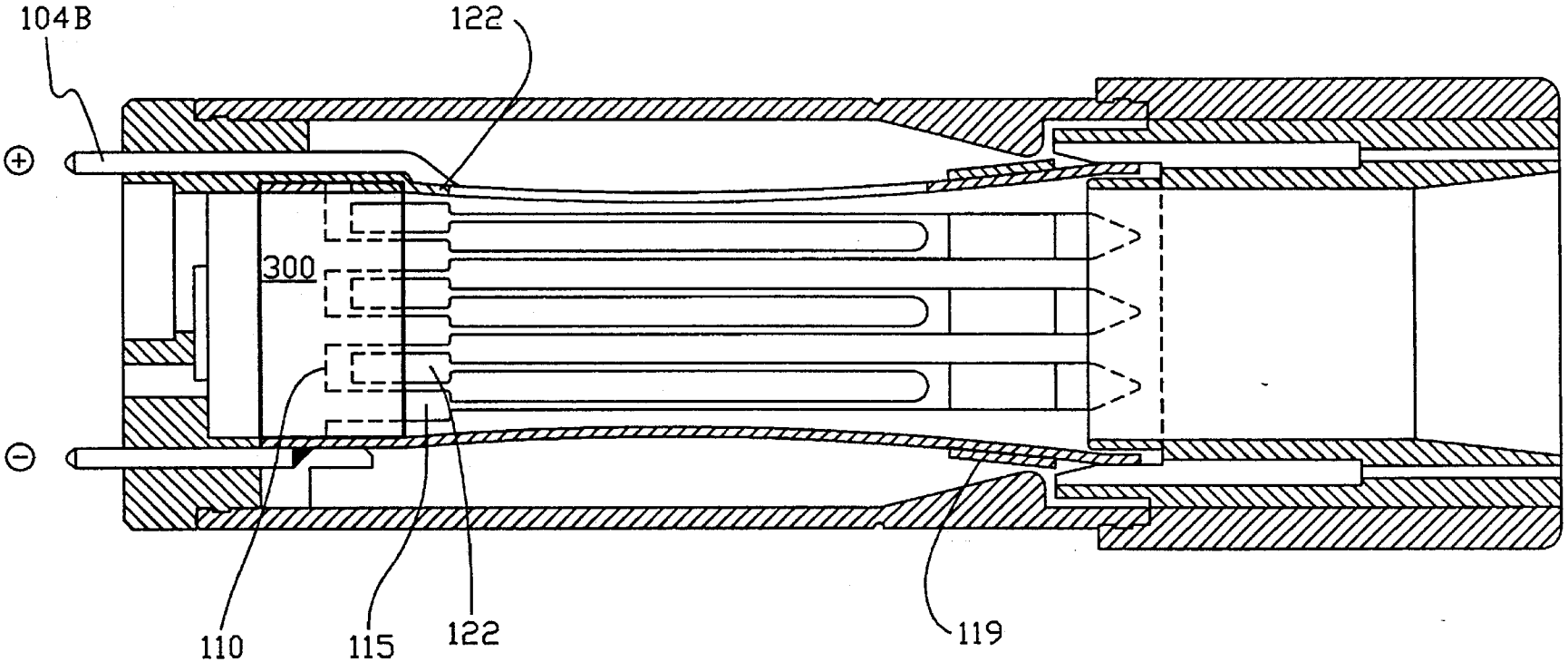
FIG. 6 is a side, cross-sectional view of a heater fixture according to the present invention employing an electrical insulator coating forming a hub.

Another embodiment for achieving the positive connections for the heater blades 120 is shown in FIGS. 5 and 6. The connecting end 122 is preferably not step-shaped as in FIGS. 3 and 4; rather, it is a substantially planar extension of second heater leg 116B, which simplifies the fabrication discussed below. To decrease the possibility of shorts arising from contact between the positive end 122 with the hub 110 and/or the section 115 of first leg 116A as, e.g., the inserted cigarette is twisted or otherwise adjusted by the smoker, an electrically insulating ceramic coating 300 is applied to end 122, hub 110 and section 115, especially to the respective facing edges of these elements.

Preferably, the ceramic coating is applied by any conventional technique, e.g., plasma spraying, to the hub 110, connecting end 122, and section 115 of first leg 116A. The ceramic preferably has a relatively high dielectric constant. Any appropriate electrical insulator can be employed such as alumina, zirconia, mulite, corderite, spinel, fosterite, combinations thereof, etc. Preferably, zirconia or another ceramic is employed having a thermal coefficient of expansion which closely matches that of the underlying metal heater structure to avoid differences in expansion and contraction rates during heating and cooling, thereby avoiding cracks and/or delaminations during operation. The ceramic layer remains physically and chemically stable as the heater element is heated. A thickness of, e.g., approximately 0.1 to 10 mils, or approximately 0.5–6 mils, and more preferably 1–3 mils, is preferred for the electrical insulator. Preferably, a portion of end 122 is not coated. Positive pins 104B are then connected as discussed to this exposed portion. To simplify masking, a corresponding portion of section 115 is likewise not coated with ceramic.

The ceramic can also be applied, e.g., in the same plasma spraying step, in the gap 125 between the ends 122 and sections 115 of first legs 116A and in the gap 126 between the ends 122 and hub 110 to form a ceramic hub structure to increase the mechanical integrity of the heater assembly, as shown in FIG. 6. The size of this ceramic hub structure can be larger than shown. With or without this additional ceramic application, the ceramic coating electrically insulates the positive connecting ends 122, and the width gaps 126 and 125 can be decreased while protection against shorts is provided. Accordingly, the end section 122 and section 115 of first leg 116A can have an increased area, thereby further strengthening the receptacle, and, in the case of the ceramic hub, increasing the skeletal structure and further strengthening the heater assembly. In addition, such a ceramic coating smooths sharp edges defining the gaps 125 and 126 to reduce the potential of snagging and damaging the cigarette, especially during insertion, removal and any adjustment by the smoker. Alternatively, the entire blade 120 and particularly first and second legs 116A and 116B are completely coated on one surface, e.g., the outer surface facing away from the cigarette, both the inner and outer surfaces, and/or the edges defining the gaps with a ceramic layer, e.g., approximately 2 mil. of zirconia, to strengthen the heater blades, maintaining gaps if desired. The blades 120 can accordingly be thinner, e.g., approximately 2 to approximately 6 mil., thereby increasing the resistance of the heater path and permitting the blades to be wider for increased thermal interface with the inserted cigarette 23 while maintaining the same overall blade resistance. This increased blade width, along with the ceramic layer, further strengthen the heater structure. Also, the ceramic coating on the outer surface of the blades 120 facing away from the inserted cigarette may prevent thermal losses from a heated blade to the ambient. The ceramic is preferably applied via plasma spraying or any other method described in the related applications and preferably is applied via electron beam physical vapor deposition to avoid inducement of residual stresses which may be induced during processing in plasma spraying from surface treatment and/or particle impact.

Each blade 120 forms a resistive heater element. More specifically, the first end 115 of first blade section 116A is electrically connected to the negative terminal of the power supply, and more specifically is an integral extension of hub 110 or is mechanically and electrically connected to hub 110, which in turn is in electrical and mechanical connected to negative terminal pin 104A via tack welding or another technique such as brazing or soldering. Preferably, two terminal pins 104A are used to provide a balanced support since the negative and positive connections also serve to mechanically support the heater. The hub 110 thus functions as an electrical common for all of the heater blades 120. In any of the embodiments, the negative connection for each heater can be made individually by, e.g., an appropriate negative contact deposited on an end of the heater opposite the respective positive contact areas 122.

A respective positive connection for each heater blade 120 is made at connecting end section 122C of the second blade section 116B as discussed. Connecting end section 122C is electrically isolated or insulated from common hub 110 by a gap 126; from first blade section 116A, and particularly first end 115, of the associated heater blade 120 by a gap 125; and from the adjacent heater blade by gap 130 to avoid shorts and to permit thermal expansion. In addition, the discussed ceramic coatings are optionally applied. Alternatively, connecting end sections 122C are respectively connected to ground.

The discussed positive and negative connections provide a resistive path, and more specifically a circuit, for current applied from the source of electrical energy, e.g., via the control circuitry, to a particular blade(s) 120 upon activation of the smoking system by a smoker's draw. The primary heated area of the blade comprises first blade leg 116A, edge portion 118A and second blade leg 116B. Accordingly, a portion of the inserted cigarette 23 underlying and contacting the actuated blade 120 extending alongside will be heated in an outer surface pattern corresponding to the heated portion of the blade, i.e., in an elongated U-shape corresponding to the overlying blade, primarily via conduction and radiation, with some convection likely occurring. In addition, the portion of the inserted cigarette between the legs, i.e., underlying gap 125, is heated by overlapping or intersecting, cumulative radiative and conductive heat transfer from both leg 116A and leg 116B. If gap 125 is too large, desired overlapping will not occur and the portion of the inserted cigarette underlying gap 125 will not be adequately heated. Also, radiative and conductive heat will heat strip portions of the inserted cigarette slightly beyond the outer edges of heater blade legs 116A and 116B. The various heated portions together constitute a heated region of the cigarette 23 that extends from slightly beyond the outer edge of leg 116A, beneath leg 116A, across gap 125, beneath leg 116B, and slightly beyond leg 116B of an actuated blade 120 and which correspond to a puff of generated tobacco flavor. The size of the heated portion is dependent upon the blade geometry and heating characteristics as well as the amount and duration of the energy pulse. Preferably, the heater blade is sized and thermally designed to ultimately heat a segment of the inserted cigarette having sufficient size, e.g., 18 square mm, to generate an acceptable puff to the smoker in response to a puff-actuated energy pulse.

Relatively larger blade end areas 115 and 122 forming a part of the current path are not heated to these operating temperatures since their relatively larger volumes lower the current density, and thus lower the ohmic heating. Also, a section of connecting end section 118 is not heated to these operating temperatures since the heating path tends to follow edge 118A and this section constitutes a relatively larger volume and accordingly has a lower current density, and thus has a lower ohmic heating, than the edge 118A and immediately adjacent sections. To further reduce undesired heating of the remainder of connecting portion 118, one can (1) increase the thickness of the monolithic material of portion 118 relative to curved edge 118A in a region 118C to further reduce current density and ohmic heating, as shown in FIG. 5, (2) perforate portion 118E to reduce ohmic and/or heat conduction paths, and/or (3) add an additional heat sink material 119 onto portion 118 to reduce thermal transfer to the portion, as shown in FIG. 6. To achieve this heat sink function, a thermally non-conductive material, i..e., a thermal insulator such as a ceramic, is applied. Examples of suitable ceramics include alumina, zirconia, a mixture of alumina and zirconia, mulite, etc., as is the case with the heater blade coating. Any of these modifications should be evaluated for any adverse effect on the mechanical integrity of connecting portions 118 which support the heater assembly 100 and define an insertion and withdrawal opening for the cigarette.

After a heater blade 120 is pulsed, there is a predetermined minimum time before a subsequent puff is permitted. Premature heating of a portion of the cigarette could also result in undesired and/or partial aerosol generation or heat-induced degradation of the cigarette portion prior to the desired heating. Subsequent reheating of a previously heated portion can result in undesired flavors and tastes being evolved.

If a longer puff is desired than is obtained by a pulsing of a single heater blade, then the control logic is configured to fire another heater or additional heater blade(s) immediately after the pulsing of the initial heater blade, or during a final portion of the initial pulsing, to heat another segment of the cigarette. The additional heater blade can be a radially successive heater blade or another heater blade. The heater blades should be sized to obtain the total desired number of puffs of a desired duration.

In one embodiment, the number of heater blades 120 corresponds to the number of desired puffs, e.g., eight. In another embodiment, the number of formed heater blades 120 is twice the number of puffs, e.g., there are sixteen portions with heaters for an eight puff cigarette. Such a configuration permits different firing sequences than the normal successive firing of approximately 2 seconds, and preferably the radially sequential firing sequence for an embodiment wherein the number of heating blades 120 corresponds to the puff count. For example, the logic circuit can dictate that two circumferentially opposite heater blades 120, i.e., heater blades separated by 180° on the tube, fire simultaneously to jointly heat an adequate amount of the cigarette to generate a puff. Alternatively, a first firing sequence of every other heater blade 120 for a cigarette is followed by a second firing sequence of the intervening heater blades 120 for the next cigarette. Alternatively, this first firing sequence can be repeated for a predetermined life cycle of numerous cigarettes and then the second firing sequence initiated. Any combination of heater blades can be employed. The number of heater blades can be less than, equal to, or greater than the number of puffs of a single employed cigarette. For example, a nine blade system can be employed for a six-puff cigarette, wherein a different set of six heaters is fired for each subsequent cigarette and the associated set of remaining three heaters is not fired.

The heater assembly 100 is electrically and mechanically relatively fixed at one end via the welding of pin(s) 104A to hub 110 and of pins 104B to ends 122. Pins 104A and 104B are preferably pre-molded into plastic hub, or otherwise fixedly connected thereto, preferably in a manner to minimize air leakage. Preferably, this fixed end is opposite the insertion opening 360. The connecting sections 118, and specifically opposite ends 118B opposite connecting edges 118A, define the insertion opening 360. End sections 118B can flare outward to define a throat section 365. Blades 120 then narrow from this throat section to define an internal diameter which is slightly less than the outer diameter of the inserted cigarette 23 at, e.g., the blade midpoint to provide desired thermal contact, i.e. compressive forces, between the blades and the cigarette. End sections 118B are free to expand when heated, i.e., end sections 118B are not fixed. More specifically, each end 118B is positioned within a corresponding channel 200 located in inner wall 201 of lighter end cap 83. More specifically, the radially outward movement of end sections 118B of inwardly biased blades 120 are arrested by ends 118B contacting radially outward walls of channels 200, thereby establishing a boundary for the biasing and defining the inward bias. This inward bias may supplemented by the inward fabrication bias as discussed. As shown, inner wall 201 is flared outward to permit insertion of a portion of blade ends 118B. The radially outward wall of channel 200 contacting end 118B is sized and shaped to permit insertion of an adequate amount of blade end 118B such that the blade end will not exit channel 200 during heating or cooling of the blade or insertion or withdrawal of the cigarette. If desired, this radially outward channel wall is provided with a rest, e.g., a trapezoid, which contacts the ends 118B. In an alternative embodiment, a portion 118D of blade end 118B is rounded, and more specifically elliptical, prior to the inserted end portion 118B. This rounded portion 118D permits the inserted portion to pivot within channel 200 in response to thermally or mechanically induced moments, thereby maintaining the inserted portion of the blade end within channel 200. Additionally or alternatively, blade ends 118B are more rounded.

In a first embodiment shown in FIG. 3, channel 200 is sized such that end 118B of the heater blade 120 can expand in a translating manner, i.e., toward end face 202 of channel 200, upon insertion of the cigarette 23 and/or heating of a blade, so that desired contact between the cigarette and the blades is achieved. Such an arrangement, wherein one end of the blade is free relative to the oppositely located hub, permits mechanical displacement and/or thermal expansion and contraction of the heater blades 120 in the longitudinal direction upon respective cigarette insertion/withdrawal and/or blade heating/cooling, thereby reducing stresses. In a second embodiment shown in FIG. 5, an abutment 204, which may be trapezoidal, is located within the channel 200 such that as heater blade 120 expands thermally upon heating or displaced as cigarette 23 is inserted, end 118B contacts abutment 204 and establishes a pivot point to allow blade 120 to bias inward toward the inserted cigarette 23, thereby reducing stresses on the blade and increasing desired thermal contact, i.e., compressive forces, between the blade and the cigarette. By pivot point, it is meant that the blade 120 is free to rotate, but preferably not translate, at this abutment 204.

The heater assembly 100 is thus preferably a monolithic structure which optionally is coated with a ceramic as discussed. The hub 110 and heater blades 120 are fabricated from a material having desired electrical resistance and strength. For example, materials having electrical resistance in the range of approximately 50 to approximately 500 μohm.cm, and more preferably approximately 100 to approximately 200 μohm.cm are preferred, such that temperatures of approximately 200° C. to approximately 1000° C., and preferably approximately 400° C. to approximately 950° C., and more preferably approximately 300° C. to approximately 850° C. are reached by the activated blade 120 in approximately 0.2 to approximately 2.0 sec. with a pulse of approximately 10 to approximately 50 Joules, more preferably approximately 10 to approximately 25 Joules, and even more preferably approximately 20 Joules. The material should be able to withstand approximately 1800 to approximately 10,000 such pulses without suffering failure, significant degradation, or undesired sagging of the blades 120.

The materials of which the heater blades 120 are made are preferably chosen to ensure reliable repeated uses of at least 1800 on/off cycles without failure. The heater fixture 39 is preferably disposable separately from the lighter 25 including the power source 37 and the circuitry, which is preferably disposed of after 3600 cycles or more. The heater materials and other metallic components are also chosen based on their oxidation resistance and general lack of reactivities to ensure that they do not oxidize or otherwise react with the cigarette 23 at any temperature likely to be encountered. If desired, the heater blades 120 and other metallic components are encapsulated in an inert heat-conducting material such as a suitable ceramic material to further avoid oxidation and reaction.

More preferably, however, the heater blades 120 and other metallic components are made from a heat-resistant alloy that exhibits a combination of high mechanical strength and resistance to surface oxidation, corrosion and degradation at high temperatures. Preferably, the heater blades 120 are made from a material that exhibits high strength and surface stability at temperatures up to about 80 percent of their melting points. Such alloys include those commonly referred to as super-alloys and are generally based on nickel, iron, or cobalt. For example, alloys of primarily iron or nickel with aluminum and yttrium are suitable. Preferably, the alloy of the heater blades 120 includes aluminum to further improve the performance of the heater element, e.g., by providing oxidation resistance.

Preferred materials include iron and nickel aluminides and most preferably the alloys disclosed is commonly assigned, copending U.S. patent applications Ser. No. 08/365,952 filed Dec. 29, 1994, and especially Ser. No. 08/426,006, filed concurrently herewith, entitled "Iron Aluminide Alloys Useful as Electrical Resistance Heating Elements" (Attorney Docket No. PM 1769), which are incorporated by reference in their entireties.

Several elements can be used as additions to the $Ni_3Al$ alloys. B and Si are the principal additions to the alloy for heater layer 122. B is thought to enhance grain boundary strength and is most effective when the $Ni_3Al$ is nickel rich, e.g., $Al \leqq 24$ at. % Si is not added to the $Ni_3Al$ alloys in large quantities since addition of Si beyond a maximum of 3 weight percent will form silicides of nickel and upon oxidation will lead to $SiO_x$. The addition of Mo improves strength at low and high temperatures. Zirconium assists in improving oxide spalling resistance during thermal cycling. Also, Hf can be added to improved high temperature strength. Preferred $Ni_3Al$ alloy for use as the substrate 300 and resistive heater 122 is designated IC-50 and is reported to comprise approximately 77.92% Ni, 21.73% A;. 0.34% Zr and 0.01% B in "Processing of Intermetallic Aluminides", V. Sikka, *Intermetallic Metallurgy and Processing Intermetallic Compounds,* ed. Stoloff et al., Van Nestrand Reinhold, N. Y., 1994, Table 4. Various elements can be added to the iron aluminide. Possible additions include Nb, Cu, Ta, Zr, Ti, Mn, Si, Mo and Ni. The heater material can be the Haynes® 214 alloy (Haynes® Alloy No. 214, a nickel-based alloy containing 16.0 percent chromium, 3.0 percent iron 4.5 percent aluminum, traces of yttrium and the remainder (approximately 75 percent), commercially available from Haynes International of Kokomo, Ind.) , Inconel 702 alloy, MCrAlY alloy, FeCrAlY, Nichrome® brand alloys (54–80% nickel, 10–20% chromium, 7–27% iron, 0–11% copper, 0–5% manganese, 0.3–4.6% silicon, and sometimes 1% molybdenum, and 0.25% titanium; Nichrome I is stated to contain 60% nickel, 25% iron, 11% chromium, and 2% manganese; Nichrome II, 75% nickel, 22% iron, 11% chromium, and 2% manganese; and Nichrome III, a heat-resisting alloy containing 85% nickel and 15% chromium), as described in commonly assigned parent patent application Ser. No. 08/380,718, filed Jan. 30, 1995 and U.S. Pat. No. 5,388,594, or materials having similar properties.

As shown in FIG. 3, the heater blades 120 are arranged to extend symmetrically from hub 110. Alternatively, non-symmetric arrangements are employed. For example, the plurality, e.g., six or eight, of heater blades 120 can be subdivided into, e.g., two equally numbered subgroups of, e.g., three or four, heater blades. The heater blades in each subgroup are separated by gaps 130 as discussed previously. The subgroups are separated by a wider gap 135, as shown in FIG. 10 in the unrolled flat state. Gap 135 is defined such that conductive and especially radiative heat transfer from adjacent blades 120 of adjacent subgroups is minimized to the portion of cigarette 23 underlying the gap 135. Accordingly, gap 135 provides a wider unheated and robust portion of the cigarette which is stronger than unheated portions of the cigarette underlying narrower gaps 130, whereby the column strength of cigarette 23 is improved to aid in removal of the cigarette after smoking and consequent heating, and weakening, of portions. If desired, the logic can activate more than one heater simultaneously in the symmetric or non-symmetric arrangement.

The present invention having two heater legs 116A and 116B separated by a gap 125 results in significant improvements in the amount of aerosol generated when compared to the amount generated by a solid heater element. A solid heater achieves good thermal transfer with the cigarette; however, mass transfer of aerosol into the drawn air flow is compromised by the solid structure blocking optimal entrainment of air located outside of the cigarette into the cigarette, especially if the enclosure of the smoking system housing is provided with perforations for communicating air outside of the enclosure to the cigarette outer surface. A heater according to the present invention having the same volume as a solid heater but having a larger perimeter results in a higher opportunity for entrainment, e.g., due to gap 125, and accordingly results in an improved flavor delivery per unit of energy to the blade 120. As discussed, gap 125 should sized to provide optimal radiation overlap for a given blade geometry. Since a higher amount of aerosols are generated, the required mass of the blades can be decreased while generating the same desired amount of flavors, resulting in a lighter unit and a decrease in the energy required to adequately heat the heater blades 120 and inserted cigarette, which further reduces the weight of the unit since the power source, e.g., batteries, can be smaller. By way of non-limiting example, gap 125 can be approximately 0.020 in., ±approximately 0.005 in. wide; blade legs 116A and 116B can be approximately 0.0125 in. to approximately 0.017 in., ±approximately 0.005 in. wide and approximately 0.55 in., ±approximately 0.005 in. long; and approximately 0.008 in. to approximately 0.010 in. thick, ±approximately 0.005 in.; and the length from the hub 110 edge to the tip of connecting section 118 can be approximately 1.062 in., ±approximately 0.0625 in.

It has been found that a primarily transverse or radial air flow relative to the inserted cigarette results in a more desirable smoke generation than a primarily longitudinal flow. The gaps 125, 126 and 130 provide pathways for air to be drawn into contact with the inserted cigarettes. Additional air passages are provided to optimize the transverse air flow by perforating sections of the heater blades.

Figure 7:
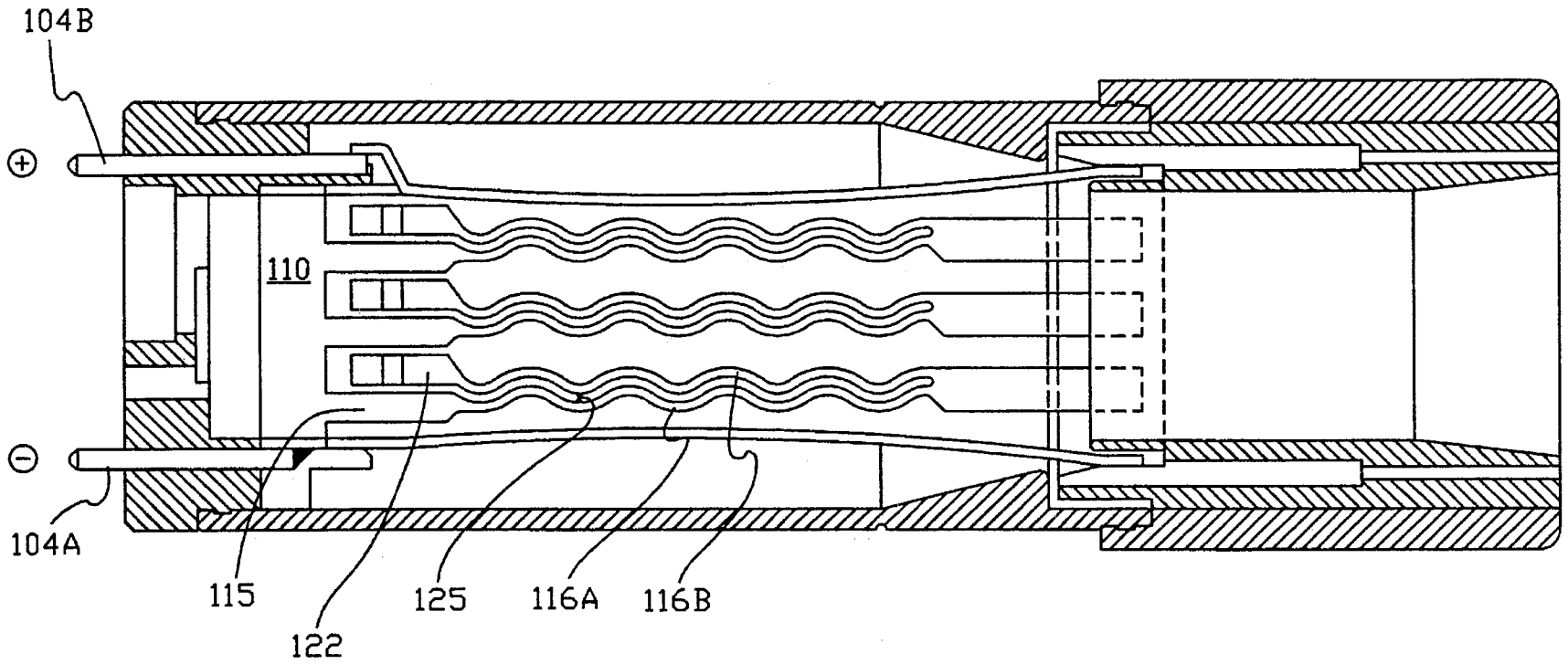
FIG. 7 is a side, cross-sectional view of a heater fixture according to the present invention having serpentine shaped heater blade legs.

Another embodiment of blade geometry is shown in FIG. 7, wherein both first leg 116A and second leg 116B are serpentine shaped. The serpentine shapes of legs 116A and 116B are parallel such that the legs are evenly spaced and gap 125 is also serpentine-shaped. Such a serpentine shape increases the blade perimeter, and thus improves the aerosol entrainment. This serpentine shape is described more fully in as described in commonly assigned parent patent application Ser. No. 08/380,718, filed Jan. 30, 1995 and U.S. Pat. No. 5,388,594.

Figure 9:
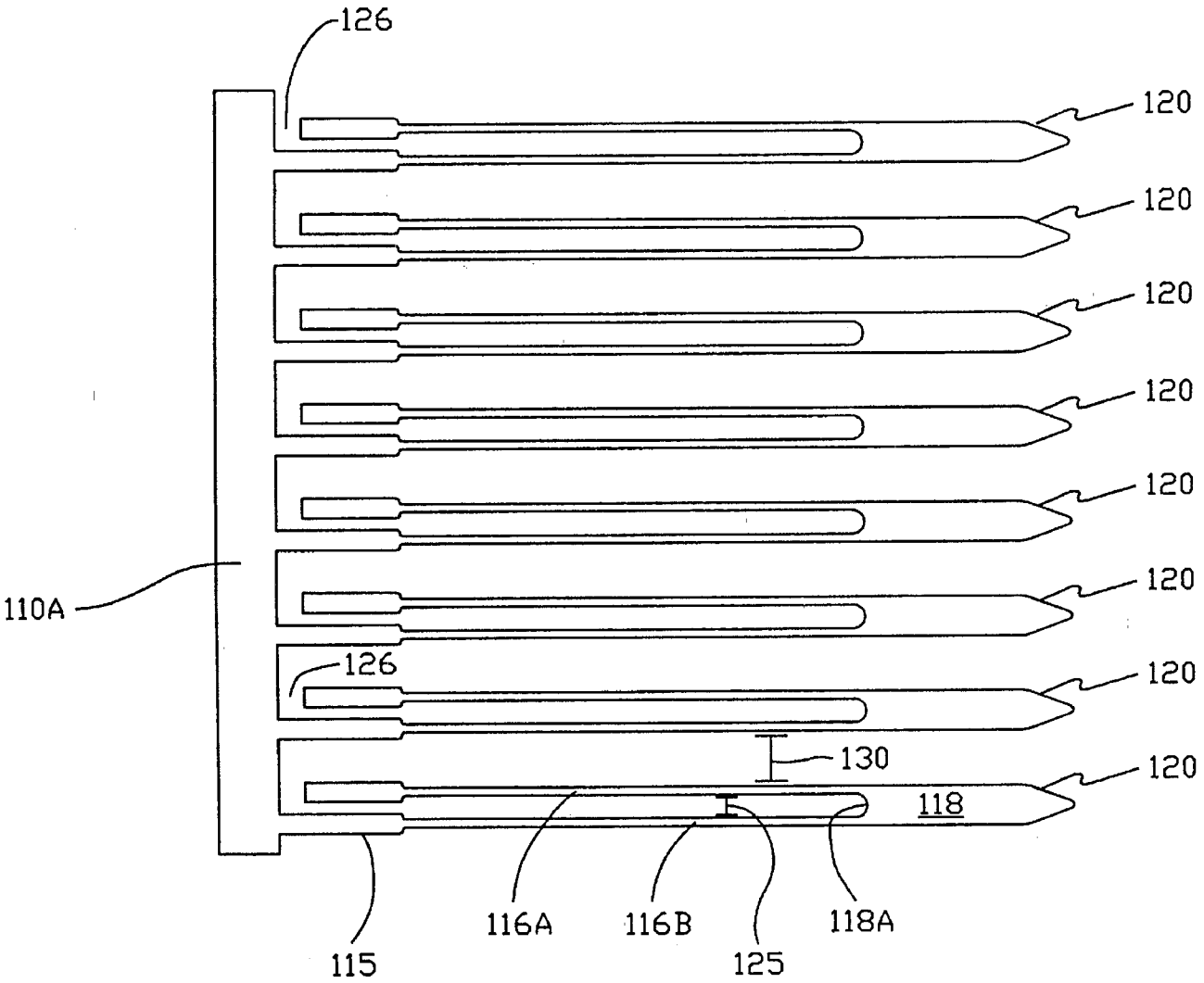
FIG. 9 is a top view of a symmetrical arrangement of heater blades in a flat state prior to rolling.

A first preferred method of fabrication will now be described with reference to FIGS. 9 and 10. The fabrication steps defined herein may be performed in any desired order to achieve manufacturing speeds, materials savings, etc.

A sheet or strip of an appropriate material having a thickness of, e.g., approximately 2 to approximately 20 mil, e.g. approximately 10 mil, is formed to define a plurality of blades 120 extending generally perpendicularly via respective first blade sections 116A, and particularly via respective first end sections 115, from a generally straight section 110A in a comb-like arrangement. The blades 120 are substantially parallel to one another with gaps 130 located between the opposing edges second blade section 116B of one blade and the first blade section 116A of an adjacent blade. As discussed, the blades 120 are either symmetrically arranged with equal gaps 130 therebetween as shown in FIG. 9, or are non-symmetrically arranged, e.g., with equal gaps 130 between adjacent blades 120 defining subgroups 120A and 120B of blades and a larger distance 131 between the two subgroups of width X as shown in FIG. 10. Note that straight section 110A has two end portions with a length of at least half the length of one half X to form a second distance 131 upon rolling. These end portions should be longer than X to provide an overlap for connection. By way of non-limiting example, gap 130 can be approximately 0.040 in., ±0.005 in. wide in any of the embodiments and gap 135 can be approximately 0.125 in., ±0.005 in. wide in the non-symmetrical embodiment.

The blades are configured as discussed previously to form connecting section 118 and the legs 116A and 116B. This formation of the sheet or strip of material into the described configuration is performed by any conventional technique such as stamping or cutting, e.g., with a CO2 or Yag laser. If a strip format is employed, the number of heater blades 120 formed from the strip can exceed the required number for a single cylindrical heater arrangement. The straight strip is then cut, if necessary, to form sections 110A having the desired number of heater blades 120 extending therefrom. If employed, the step shape of sections 122A, 122B and 122C is formed via stamping.

If employed, ceramic coating 300 is then applied by masking the stamped profile and, e.g., thermally spraying the coating onto sections 110A, 115, 122 or the entire blade or any portion thereof to form the desired pattern as discussed. Alternatively, the ceramic coating is applied after the rolling step by this procedure or, if desired, prior to formation of the blades. As is known, appropriate maskings are applied prior to performing each of the steps of heater and ceramic deposition to define areas of application.

The section 110A is then rolled to form round hub 110. The section 110A can be rolled in either direction. Preferably, section 110A is rolled such that the positive contacts 122C at end section 122 are on the outer surface of the formed cylindrical heater, i.e., the side opposite the cigarette, to simplify connection with pins 104B and to avoid damage during insertion and removal of the cigarette. The rolled section can be rolled to a smaller diameter than its ultimate desired diameter and is inserted into the fixture. The rolled section then expands and is further held in shape by the electrical connections. Alternatively, the rolled section is joined, e.g., via any welding technique such as spot welding or laser welding, to form the hub 110.

Preferably a bias is imposed on each blade 120 such that legs 116A and 116B and connecting edge 118A will exert a compressive force on the inserted cigarette when the heater assembly is formed, as shown in FIG. 4. This biasing preferably occurs prior to rolling, but may be implemented after rolling. This biasing increases the thermal contact between the heater blade and the inserted cigarette to improve thermal transfer efficiency.

Figure 8A:
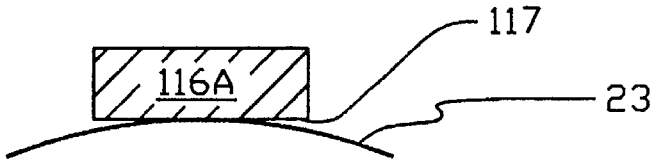
FIG. 8A is front, cross-sectional view of a heater blade having a planar underside facing an inserted cigarette.
Figure 8B:
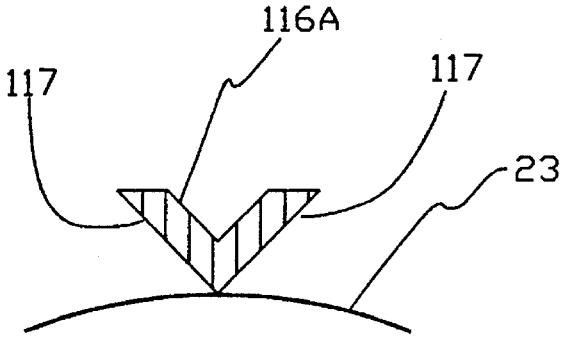
FIG. 8B is a front, cross-sectional view of a heater blade having an angled underside facing an inserted cigarette.
Figure 8C:
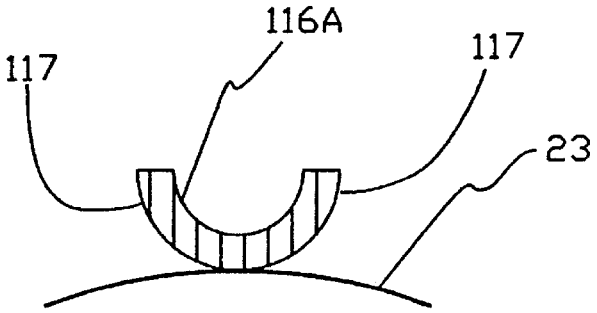
FIG. 8C is a front, cross-sectional view of a heater blade having a curved underside facing an inserted cigarette.

Thermal transfer efficiency is also improved by optimizing the amount of surface areas of the blade legs 116A and 116B which are in an efficient thermal relationship with the underlying cigarettes. As seen in FIG. 8A, the undersides 117 of legs 116A and 116B (leg 116A is shown by way of example) is planar, i.e., flat in a transverse direction of the blade leg in the discussed embodiments. To improve the thermal transfer relationship, the underside 117 is shaped in various non-planar geometries, e.g., an angle or curve to maximize the surface area of the heated leg relative to the cigarette without undesirably increasing the volume, and hence undesirably lowering the current density and resultant ohmic heating of the heater leg, as respectively depicted in FIGS. 8B and 8C. The shaped underside 117 preferably does not pierce any part of the cigarette 23 to avoid weakening and possibly ripping the cigarette during insertion, adjustment or removal. Rather, the midpoint or apex of the underside 117 contacts or is in close thermal proximity to cigarette 23, and the remainder of underside 117 is in a radiative thermal relationship with cigarette 23.

Preferably, this underside shape is achieved by stamping the legs 116A and 116B of the blades 120 in an unrolled state. This stamping can occur at the same time as the stamping to achieve the bias discussed above. This stamping to shape the underside also increases the strength of legs 116A and 116B, thereby avoiding undesired shorts and deformations.

A second method of fabrication will now be described. A tube of appropriate material is provided. The blades 120 are then formed via any technique such as laser cutting. Alternatively, the blades are formed by a swaging technique wherein an internal mandrel is inserted into the tube to form the discussed blade profiles and then another swage, either internally or externally, is employed to cut the profile. A ceramic coating 300, if desired, is provided as discussed to the profiled tube.

The present invention also minimizes potentially damaging thermally induced stresses. Since the heater blades 120 and hub 110 are monolithic, stresses arising from interconnections of discrete portions of a heater element are avoided.

The various embodiments of the present invention are all designed to allow delivery of an effective amount of flavored tobacco response to the smoker under standard conditions of use. Particularly, it is presently understood to be desirable to deliver between 5 and 13 mg, preferably between 7 and 10 mg, of aerosol to a smoker for 8 puffs, each puff being a 35 ml puff having a two-second duration. It has been found that, in order to achieve such delivery, the heater elements 120 should be able to convey a temperature as discussed when in a thermal transfer relationship with the cigarette 23. Further, the heater blades 120 should preferably consume the discussed energy. Lower energy requirements are enjoyed by heater blades 120 that are bowed inwardly toward the cigarette 23 to improve the thermal transfer relationship.

Of course, the heater resistance is also dictated by the particular power source 37 that is used to provide the necessary electrical energy to heat the heater blades 120. For example, the above heater element resistances correspond to embodiments where power is supplied by four nickel-cadmium battery cells connected in series with a total non-loaded power source voltage of approximately 4.8 to 5.8 volts. In the alternative, if six or eight such series-connected batteries are used, the heater blades 120 should preferably have a resistance of between about 3 Ω and about 5 Ω or between about 5 Ω and about 7 Ω, respectively.

Figure 11:
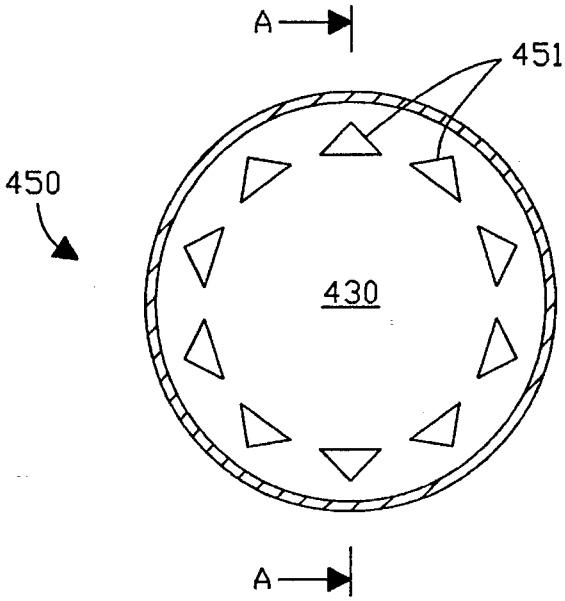
FIG. 11 is a radial cross-sectional view of the electrical smoking system of the present invention, showing an alternative heater embodiment.
Figure 12:
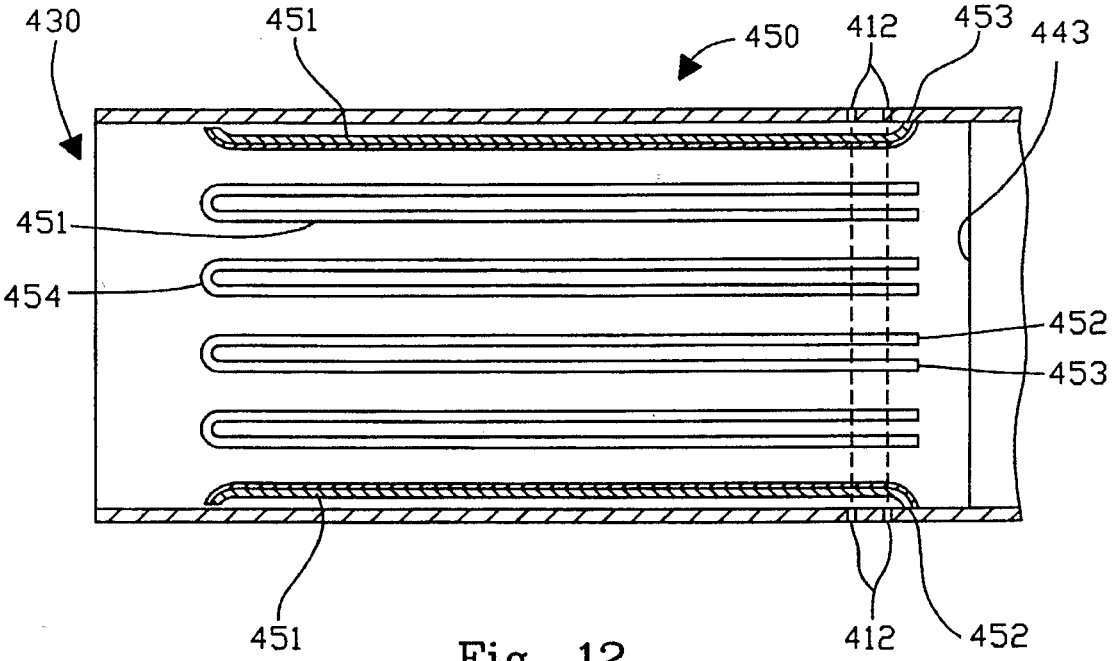
FIG. 12 is a longitudinal cross-sectional view of the flavor cartridge receiving cavity of the electrical smoking system of FIG. 11, taken from line A—A of FIG. 11.

Another embodiment 450 of the present invention is shown in FIGS. 11 and 12 comprising a plurality of heating elements 451. Each heating element 451 is in the shape of an elongated "U", each having both of its ends 452, 453 of respective legs connected to the side wall of cavity 430 adjacent end wall 443 of cavity 430. Each respective end 452 is individually connected to the control circuitry, and ultimately to the source of electrical energy, for individual actuation of heating elements 451, while ends 453 are connected in common to ground. While ends 454 adjacent the mouth end of cavity 430 are not electrically connected, and thus need not touch the side wall of cavity 430, they are nonetheless turned toward the side wall of cavity 430, as shown in both FIGS. 11 and 12, to provide a lead-in for the disposable portion, i.e., the inserted cigarette, as discussed above. It should be noted that in FIG. 12, the uppermost and lowermost elements 451 are shown cut through their U-shaped tips 454.

Figure 13:
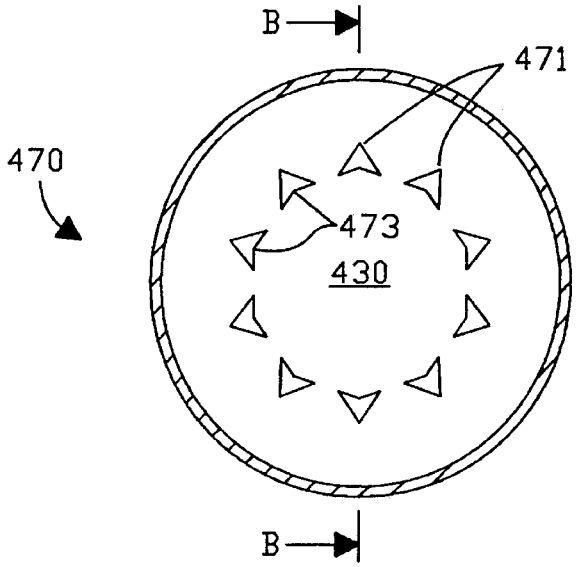
FIG. 13 is a radial cross-sectional view showing another alternative heater embodiment.
Figure 14:
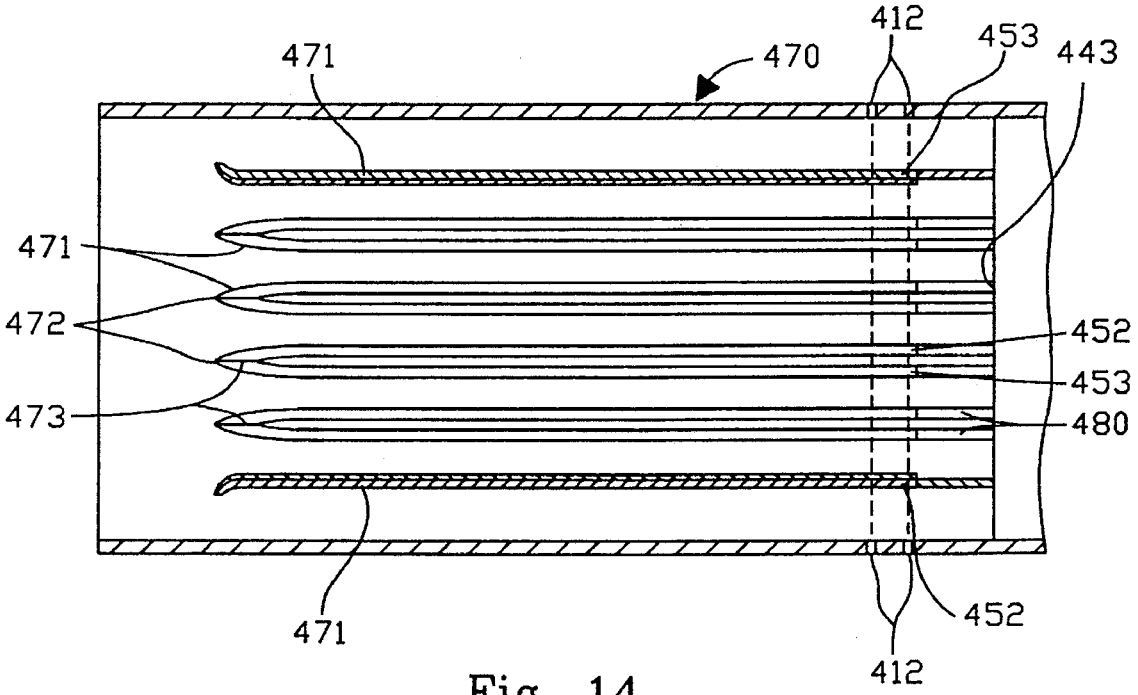
FIG. 14 is a longitudinal cross-sectional view of the flavor cartridge receiving cavity of the electrical smoking system of FIG. 13, taken from line B—B of FIG. 13.

In another embodiment 470 shown in FIGS. 13 and 14, heating elements 471 are spaced somewhat further from the wall of cavity 430, and each is provided with a somewhat sharper "V" tip 472, as well as with fold 473 to increase their rigidity. In this way, heating elements 471 actually pierce and extend into the disposable portion to provide the desired intimate thermal contact. The open-cell foam structure described above is particularly well-suited for such an embodiment. In this embodiment, because heating elements 471 are spaced further from the side wall of cavity 430, ends 452, 453 are not attached to the side wall of cavity 430, but to its end wall 443. Preferably, the connections of ends 452, 453 to end wall 443 are made through spacers 480 which are not conductive of either heat or electricity. In this way, a wiping action wipes residue past ends 452, 453 and onto spacers 480, where the residues are not reheated, as described more fully in U.S. Pat. No. 5,249,586. Perforations 412 are provided in the wall to allow outside air to be drawn through portion 420, as described more fully in U.S. Pat. No. 5,249,586, which is incorporated by reference in its entirety.

Many modifications, substitutions and improvements may be apparent to the skilled artisan without departing from the spirit and scope of the present invention as described and defined herein and in the following claims.

We claim:

1. A heater for use in a smoking system having a source of electrical energy for heating a cigarette, the heater comprising:

a plurality of electrically resistive heater blades defining a receptacle to receive an inserted cigarette and extending alongside the inserted cigarette, each blade comprising a first heater blade leg having a first end and a second end, a second heater blade leg having a first end and a second end, and a connecting section comprising a connecting edge section connecting the second end of said first heater blade leg and the first end of said second heater blade leg;

wherein said first and second heater blade legs of each heater blade are separated by a respective gap; and wherein the first ends of each first heater blade leg are in electrical contact with the source of electrical energy, wherein respective resistive heating paths are formed comprising said first heater blade leg, said connecting edge section, and said second heater blade leg to respectively heat each of said electrically resistive heater blades, which in turn heats the inserted cigarette.

2. The heater according to claim 1, wherein the second ends of said second heater blade legs are grounded.

3. The heater according to claim 1, wherein the second ends of said second heater blade legs are connected in common.

4. The heater according to claim 1, wherein the second ends of said second heater blade legs are connected in common to ground.

5. The heater according to claim 1, wherein the gap separating said first and second heater blade legs is of sufficient size to permit entrainment of air flow into the heated cigarette upon drawing by a smoker.

6. The heater according to claim 1, further comprising a supporting hub, the first ends of each of said first heater blade legs extending from said supporting hub;

wherein said supporting hub is in electrical contact with the source of electrical energy to form a common for the first ends of said first heater blade legs.

7. The heater according to claim 6, wherein the second ends of said second heater blade legs are in respective electrical contact with the source of electrical energy, wherein respective resistive heating circuits are formed comprising said first heater blade leg, said connecting edge section, and said second heater blade leg to respectively heat each of said electrically resistive heater blades, which in turn heats the inserted cigarette.

8. The heater according to claim 6, wherein the second ends of said second heater blade legs extend toward said supporting hub and are electrically insulated therefrom.

9. The heater according to claim 6, wherein the second ends of said second heater blade leg is separated from said hub by a gap.

10. The heater according to claim 6, further comprising an electrical insulator applied to at least one of said hub and the second ends of said second heater blade legs.

11. The heater according to claim 6, further comprising an electrical insulator applied to at least one of the second ends of said second heater blade legs and the first ends of said first heater blade legs.

12. The heater according to claim 6, further comprising an electrical insulator forming a ceramic hub support structure around said supporting hub, the second ends of said second heater blade legs and the first ends of said first heater blade legs.

13. The heater according to claim 6, wherein the supporting hub and blades are monolithic.

14. The heater according to claim 1, wherein said connecting section further comprises a free end to compensate for thermal expansion when the heater element is heated.

15. The heater according to claim 14, further comprising a support structure stationarily located within the smoking system and defining channels to receive the free ends of said connecting sections of said blades.

16. The heater according to claim 14, wherein said channels are sized to permit translational thermal expansion and contraction of said heater blades.

17. The heater according to claim 14, further comprising a pivot point located in each of said channels, said pivot point located such that the associated free end of said connecting section pivots about said pivot point to bias said first and second heater blade legs inward toward the inserted cigarette upon heating of the associated heater blade.

18. The heater according to claim 1, wherein portions of at least one of said first heater blade leg and said heater blade leg are coated with a ceramic to strengthen and electrically insulate the at least one of said first heater blade leg and said heater blade leg.

19. The heater according to claim 18, wherein a portion of said second heater blade leg adjacent said ceramic is in electrical contact with the source of electrical energy.

20. The heater according to claim 1, wherein said blades are arranged to slidingly receive the inserted cigarette.

21. The heater according to claim 1, wherein said blades are shaped to define as insertion opening having an internal diameter greater than the defined receptacle for receiving the inserted cigarette.

22. The heater according to claim 21, wherein said blades further define a throat section between said insertion opening and the defined receptacle, said throat section having a gradually decreasing diameter from said insertion opening to the defined receptacle.

23. The heater according to claim 1, wherein the second end of said second heater blade leg is a step shape, said step shape comprising an end section adapted to be in electrical contact with the source of electrical energy.

24. The heater according to claim 1, wherein said first and second heater blade legs of a respective heater blade are substantially parallel.

25. The heater according to claim 1, wherein said connecting edge has a curvature between approximately 160° and 200°.

26. The heater according to claim 1, wherein an underside of at least one of said first and second heater blade legs facing the inserted cigarette is substantially non-planar in a transverse direction of said heater blade leg.

27. The heater according to claim 26, wherein said underside is curved.

28. The heater according to claim 26, wherein said underside is angled.

29. The heater according to claim 1, wherein said plurality of electrically resistive heater blades are arranged in groups, wherein gaps between the groups are sized to provide unheated portions of the inserted cigarette providing strength to facilitate removal of the cigarette after smoking.

30. The heater according to claim 1, wherein at least one of said first and second heater blade legs is serpentine shaped.

31. The heater according to claim 1, wherein the first end of said first heater blade leg of at least one blade is wider than an adjacent active portion of said first heater blade leg, wherein the first end of said first heater blade leg has a lower current density and a lower ohmic heater than the active portion of said first heater blade leg.

32. The heater according to claim 1, wherein the second end of said second heater blade leg of at least one blade is wider than an adjacent active portion of said second heater blade leg, wherein the second end of said second heater blade leg has a lower current density and a lower ohmic heating than said active portion of said second heater blade leg.

33. The heater according to claim 1, wherein said connecting section further comprises a remainder section having a larger volume than said connecting edge section to have a lower current density and lower ohmic heating than said connecting edge section.

34. The heater according to claim 33, wherein the remainder section of said connecting section is thicker than said connecting edge section to reduce current density and ohmic heating of said connecting section.

35. The heater according to claim 33, further comprising a heat sink communicating with said connecting section.

36. The heater according to claim 1, wherein said connecting section is perforated.

37. The heater according to claim 1, wherein said first and second heater blade legs are biased inwardly toward the inserted cigarette.

38. The heater according to claim 1, wherein said first and said second heater blade legs and said connecting edges have a resistance of approximately 100 to approximately 200 μohm.cm.

39. The heater according to claim 1, wherein said first and said second heater blade legs and said connecting edges have a resistance of approximately 50 to approximately 500 μohm.cm.

40. The heater according to claim 1, wherein said first and second heater blade legs and said connecting edges form an electrical path of such resistance such that, upon pulsing, the legs and edges reach temperatures of approximately 200° C. to approximately 1000° C. in approximately 0.2 to approximately 2.0 sec. with a pulse of approximately 10 to approximately 50 Joules.

41. The heater according to claim 40, wherein said first and second legs and said connecting edges form a resistance heating element of sufficient physical strength such that the resistance heating element is capable of being pulsed to these temperatures approximately 1800 to approximately 10,000 such pulses without failure.

42. The heater according to claim 1, wherein said first and second heater blade legs and said connecting edge sections comprise an electrically resistive material selected from the group consisting of iron aluminides and nickel aluminides.

43. A heater for use in a smoking system having a source of electrical energy for heating a cigarette, the heater comprising:

a plurality of electrically resistive heater blades, each blade comprising a first heater blade leg having a first end and a second end, a second heater blade leg having a first end and a second end, and a connecting section comprising an electrically conductive section connecting the second end of said first heater blade leg and the first end of said second heater blade leg;

wherein said first and second heater blade legs are parallel, serpentine, and are separated by a respective gap; and wherein the first ends of said first heater blade leg are in electrical contact with the source of electrical energy, wherein respective resistive heating paths are formed comprising said first heater blade leg, said connecting edge section, and said second heater blade leg to respectively heat each of said electrically resistive heater blades, which in turn heats the inserted cigarette.

44. A heater as claimed in claim 43, wherein the gap between the first and second heater blade legs is an even space between said legs and is serpentine shaped.

* * * * *